US007498111B2

(12) United States Patent
Asano et al.

(10) Patent No.: US 7,498,111 B2
(45) **Date of Patent: *Mar. 3, 2009**

(54) ELECTROPHOTOGRAPHIC PHOTORECEPTOR AND AN IMAGE FORMING METHOD EMPLOYING THE SAME

(75) Inventors: Masao Asano, Tokyo (JP); Hiroshi Yamazaki, Hachioji (JP); Nobuaki Kobayashi, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 307 days.

This patent is subject to a terminal disclaimer.

(21) Appl. No.: 10/863,569

(22) Filed: Jun. 8, 2004

(65) Prior Publication Data

US 2005/0271967 A1 Dec. 8, 2005

(51) Int. Cl.
*G03G 5/00* (2006.01)

(52) U.S. Cl. ..... 430/97; 430/108; 430/110.4

(58) Field of Classification Search ..... 430/97, 430/105, 110.4, 125, 108, 120
See application file for complete search history.

(56) References Cited

U.S. PATENT DOCUMENTS

| | | | | |
|---|---|---|---|---|
| 5,434,027 | A * | 7/1995 | Oshiba et al. | 430/58.85 |
| 6,689,522 | B2 * | 2/2004 | Yamazaki et al. | 430/45 |
| 6,902,856 | B2 * | 6/2005 | Matsushima et al. | 430/45 |
| 7,135,262 | B2 * | 11/2006 | Itami | 430/100 |
| 2003/0054269 | A1 * | 3/2003 | Yamazaki et al. | 430/45 |
| 2003/0190547 | A1 * | 10/2003 | Kobayashi et al. | 430/125 |
| 2005/0271959 | A1 * | 12/2005 | Kobayashi | 430/60 |

FOREIGN PATENT DOCUMENTS

| | | | |
|---|---|---|---|
| JP | 08137115 | | 5/1996 |
| JP | 8-179521 | * | 7/1996 |
| JP | 11072960 | | 3/1999 |
| JP | 11327173 | | 11/1999 |
| JP | 2000221708 | | 8/2000 |
| JP | 2001324834 | | 11/2001 |
| JP | 2003-295480 | | 10/2003 |

OTHER PUBLICATIONS

Abstract of JP 2002244336.*
Abstract of JP 2003015345.*
Abstract of JP 2003084473.*
Abstract of JP 2003084480.*
Abstract of JP 2003098751.*
U.S. Appl. No. 10/853,699.*
JP 4-162042 abstract.*
JP 8-179521 abstract.*
JP 9-34136 abstract.*
JP 2000-305292 abstract.*
Machine English language translation of JP 8-179521.*

* cited by examiner

*Primary Examiner*—Hoa V Le
(74) *Attorney, Agent, or Firm*—Lucas & Mercanti, LLP

(57) ABSTRACT

Disclosed is an electrophotographic photoreceptor which comprises a layer on a support, wherein the photoreceptor satisfies a condition represented by Formulas 1 and 2;

$$0<P_{max}<2P \quad \text{Formula 1}$$

$$2\leqq(P_{max}/D)\times100\leqq50 \quad \text{Formula 2}$$

wherein P represents an average of the layer thickness in μm at the central portion in the width direction of image forming area of the support, $P_{max}$ represents is an average of the largest value of the layer thickness in μm without the image forming area, D represents an average of the distance in μm from the point where the largest value is formed to the edge of the layer and a image forming method and an apparatus using the same.

16 Claims, 10 Drawing Sheets

FIG. 1 ( a )
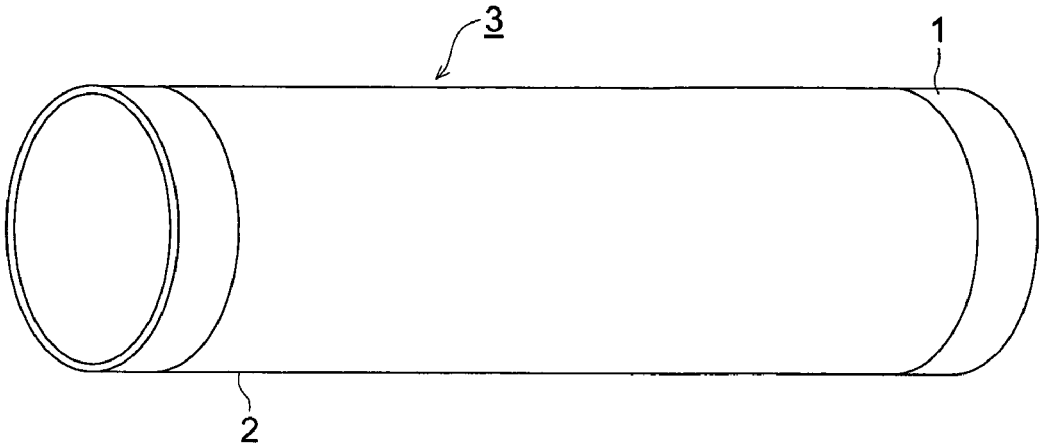
FIG. 1 ( b )
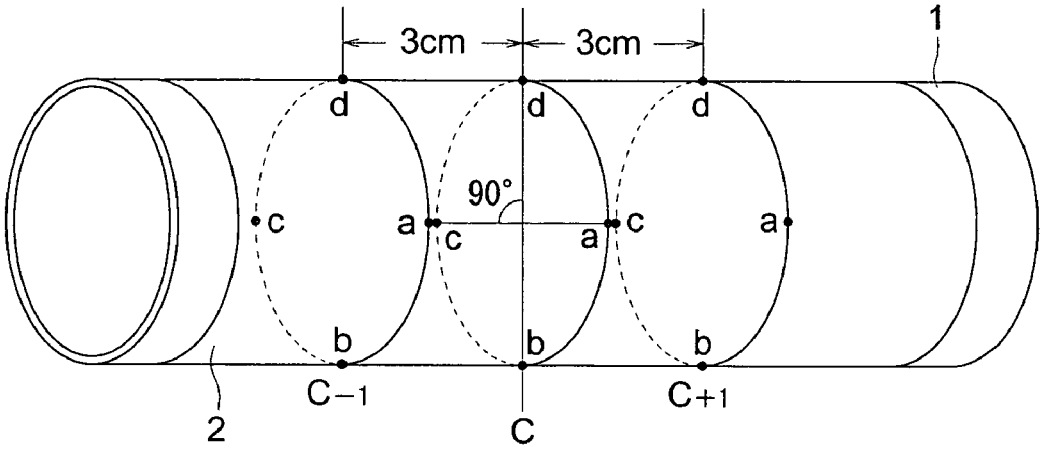
FIG. 1 ( c )
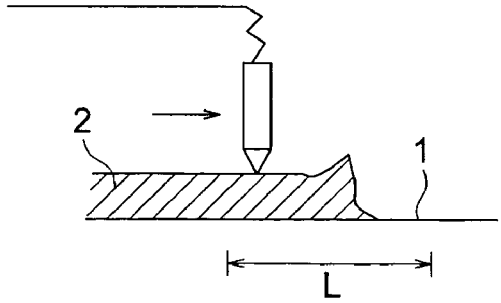

FIG. 2
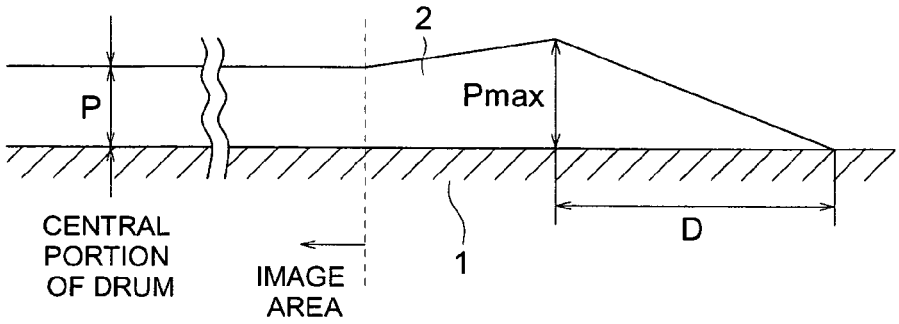
FIG. 3 ( a )
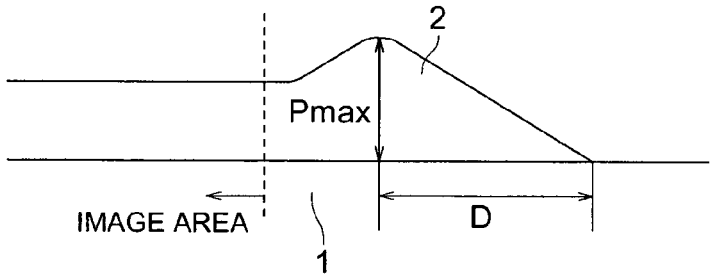
FIG. 3 ( b )
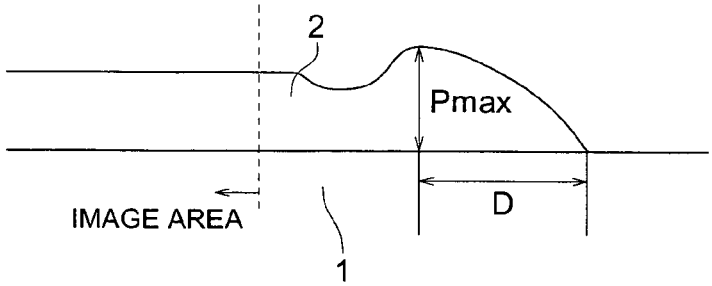
FIG. 3 ( c )
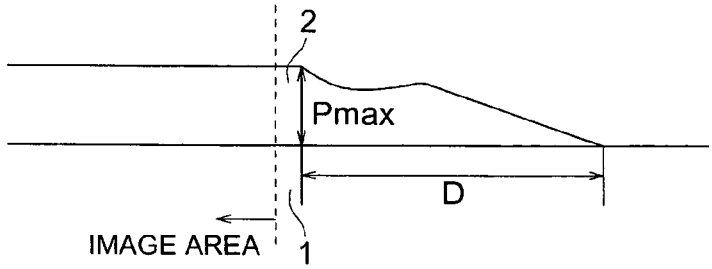

FIG. 10 ( a )
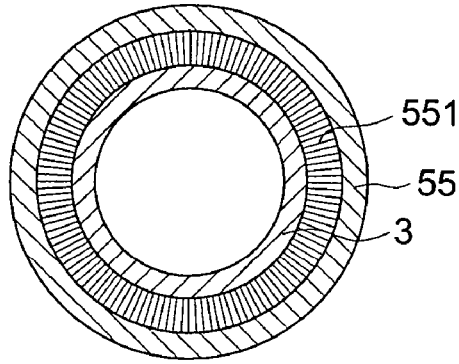
FIG. 10 ( b )
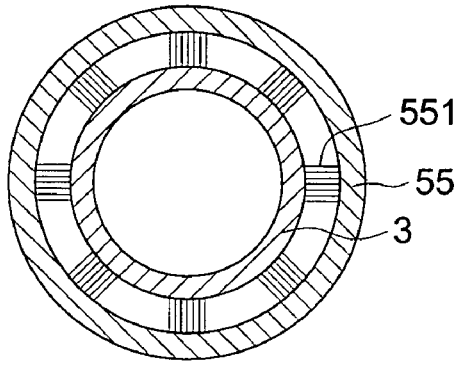
FIG. 10 ( c )
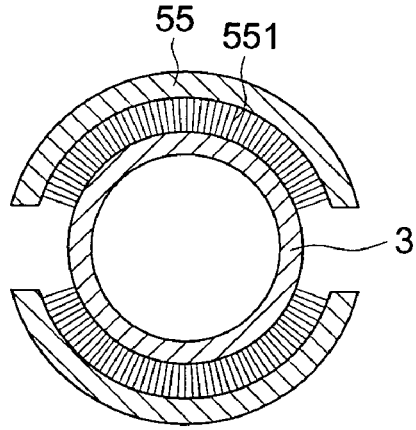

ELECTROPHOTOGRAPHIC PHOTORECEPTOR AND AN IMAGE FORMING METHOD EMPLOYING THE SAME

BACKGROUND

1. Technical Field

The invention relates to an image forming method, image forming apparatus and a processing cartridge and an electrophotographic photoreceptor to be employed thereto, which are used for a copying machine, a laser beam printer and a facsimile machine.

2. Related Art

The electrophotographic photoreceptor is usually manufactured by immersing a cylindrical electroconductive support into a coating liquid such as a photosensitive layer coating liquid, an intermediate layer coating liquid and a surface protective layer coating liquid to form a coated layer. In such the case, the coated layer is entirely formed on the surface of the cylindrical electroconductive support since the support is immersed in the coating liquid. When the photoreceptor drum entirely coated with the layer is installed in an electrophotographic apparatus, the coated layer is occasionally peeled off by contacting to parts such as a roller to be touched to a developing device, and the photoreceptor drum cannot be utilized as the contacting point for grounding. Consequently, it is preferable to remove the coated layer adhered at the both end portions of the photoreceptor drum.

As the method for removing the coated layer, methods have been known such as the method described in Japanese Patent Publication Open to Public Inspection, hereinafter referred to as Japanese Patent O.P.I. Publication, No. 63-311357 in which the end portion of the photoreceptor drum is immersed in an solvent and vibrated by ultrasonic wave, the method described in Japanese Patent O.P.I. Publication Nos. 3-60782, 4-141663, 5-142789, 10-207084, 11-184100 and 11-194509 in which the coated layer is scoured off by a brush, and the method employing a tape. The following methods have been known, for example, the method described in Japanese Patent O.P.I. Publication No. 4-65376 in which a tape composed of heat-bonded type nonwoven fabric is successively let out and then a solvent is supplied to the tape, and the tape is contacted to the photoreceptor drum to remove the photosensitive layer the method in which a tape impregnated with a solvent is let out and the tape is contacted to the photoreceptor drum to remove the coated layer, and the method using a nonwoven fabric having uneven surface on one side described in Japanese Patent O.P.I. Publication No. 9-281725.

In any method, however, problems occur such as that the coated layer near the end portion of the photoreceptor where the coated layer is removed is tends to be peeled off, and the toner is accumulated at the end portion of the photoreceptor so as to cause insufficient cleaning and contamination of interior of the apparatus by the toner. As a result of that the durability of the photoreceptor drum and the cleaning member is extremely degraded. Consequently, it is demanded that the shape of the coated layer is developed which does not cause such the problems.

Recently, an organic photoreceptor containing an organic photo-electroconductive substance is most widely employed as the photoreceptor to be used in the image forming apparatus.

The organic photoreceptor is superior to another photoreceptor in that the material capable of corresponding to various exposure light source from visual to infrared rays can be easily developed, the material causing no environmental pollution can be selected and the production cost is low. However, the mechanical strength of the organic photoreceptor is low. Therefore, it has a drawback that the degradation of the photoreceptor surface and the occurrence of damages ten to occur.

Moreover, the toner remained on the photoreceptor after the transfer of the toner image to the image receiving material is difficultly removed since the contact energy of the organic photoreceptor with the toner visualizing the static latent image is large. Accordingly, various problems are raised on the cleaning of the photoreceptor surface.

On the other hand, the image formation by a digital system becomes to the main stream of the electrophotographic image formation accompanied with the progress of the digital technology. The image formation method according to the digital system is based on the visualization of a fine dot image such as 400 dpi (number of dot per inch or 2.54 cm). A high quality imaging technology capable of conscientiously visualizing such the fine dot image is required.

As an important means of the high quality imaging technology, reducing of a fine particle size of the toner, unifying the size and the shape of the toner particle are attempt, and the electrophotographic developer and an image forming method employing a polymerized toner are proposed. The toner having uniform size and shape can be obtained by the polymerization since such the toner particle is prepared by polymerizing a monomer dispersed in an aqueous medium. Such the powder system, however, has complicated physical properties and strong coagulating force even though high sharpness and image quality can be obtained. Consequently, problems such as formation of unevenness of the halftone image and black spots caused by the adhesion of the toner to the photoreceptor or the coagulation of the toner itself and insufficient cleaning such as toner filming and turn off of the cleaning blade tend to occur.

The importance of the fine particle toner is increasingly raised for forming a high quality image in the recent stream of the digitization. Moreover, the toner recycle system for reusing the toner recovered from the photoreceptor by cleaning is advantageous from the viewpoints of the resource saving, pollution prevention and cost saving of image formation.

However, when the fine particle toner is employed in an usual image forming method, various image defects such as coagulation of the toner at the edge portion of the photoreceptor, scattering of the toner caused by the coagulation and peeling of the photoreceptive layer at the edge portion of the photoreceptor caused by the strong stress on the occasion of the cleaning are formed in a period of prolonged development. Such the defects are become considerably when the toner recycle system is applied.

The relation of the shape of the edge of photoreceptive layer and the size distribution of the toner particles not causing the above problems is required. Therefore, an electrophotographic image forming method, image forming apparatus, a processing cartridge and an electrophotographic photoreceptor to be used thereto are demanded, by which the coated layer is not peeled off, the toner is not accumulated and the image defects such as black spot caused by scatter of the powdered coated layer and the toner particle are not formed.

SUMMARY

An image forming method comprising:

developing a latent image formed on an image bearing member with a toner, wherein the image bearing member comprises a support and a layer and the photoreceptor satisfies a condition represented by Formulas (1) and (2), and the toner has a ratio (Dv50/Dp50) of 50% volume particle diameter of the toner (Dv50) to 50% number particle diameter of the toner (Dp50) within the range of 1 to 1.15, a ratio (Dv75/Dp75) of the cumulative 75% volume particle diameter from the largest particle diameter of the toner (Dv75) to the cumulative 75% number particle diameter from the largest particle diameter of the toner (Dp75) within the range of 1 to 1.2 and 10% or less of the number of toner particles having a particle diameter of not larger than 0.7×Dp50 in the toner based on all the toner particles in the toner;

$$0<P_{max}<2P \quad \text{Formula (1)}$$

$$2\leqq(P_{max}/D)\times100\leqq50 \quad \text{Formula (2)}$$

wherein P represents an average of the layer thickness in μm at the central portion in the width direction of image forming area of the support, $P_{max}$ represents is an average of the largest value of the layer thickness in μm without the image forming area, D represents an average of the distance in μm from the point where the largest value is formed to the edge of the layer.

BRIEF DESCRIPTION OF THE DRAWINGS

The present invention will become more fully understood from the detailed description given herein below and the accompanying drawings which are given by way of illustration only, and thus are not intended as a definition of the limits of the present invention, and wherein;

FIGS. 1(*a*) to 1(*c*) each is a drawing describing the electrophotographic photoreceptor drum and the defined value utilizing in the invention.

FIG. 2 is a schematic enlarged cross section of the edge portion of the coated layer.

FIGS. 3(*a*) to 3(*c*) is a schematic drawing of the microscopic cross section of the portion where the photosensitive layer is removed by scouring.

FIGS. 10(*a*) to 10(*c*) each is displays an embodiment of the scouring member.

DETAILED DESCRIPTION

Figure 4:
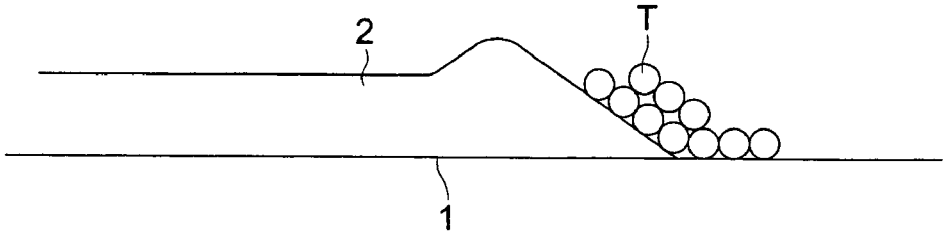
FIG. 4 is a conceptual cross section showing the situation of adhesion of the accumulated toner or the coagulated toner.

The essential matters, employed members, image forming apparatus and image forming method are described below. However, the invention is not limited to the description; and it is not intended to exclude any obvious substitution and replacement. The electrophotographic photoreceptor and the defined value utilized in the invention are described referring FIG. 1.

Herein, the coated layer contains the entire layers coated on the support according to necessity such as a photosensitive layer including a charge generation layer and a charge transfer layer of a function separated type photoreceptor, an intermediate layer and a surface protective layer.

The electrophotographic photoreceptor drum 3 has the shape as displayed by the cross section of FIG. 1(*a*), and is constituted by an electroconductive support 1 on the surface of which the photosensitive layer, and the intermediate layer and the surface protective layer are coated according to necessity. It is desirable that the both edge portions of the coated layer on the photoreceptor drum are completely removed, and the shape of the edge is also important.

The measuring method of the average value P (μm) of the layer thickness at the central portion of the photosensitive layer utilizing to the definition of the invention is described below.

The average value P of the layer thickness at the central portion of the photosensitive layer is described referring FIG. 1(*b*). The layer thickness is measured at four positions each making a right angle on each of the cross sections at the center C and the positions $C_{-1}$ and $C_{+1}$ each apart 3 cm from C, namely Ca, Cb, Cc, Cd, $C_{+1}$a, $C_{+1}$b, $C_{+1}$c, $C_{+1}$d, $C_{-1}$a, $C_{-1}$b, $C_{-1}$c and $C_{-1}$d. The average of the layer thicknesses at the above twelve points is defined as P. A swirl electric current type layer thickness measuring apparatus EDDY560C, manufactured by Helmut Fischer GMBTE Co., Ltd., is used for measuring the layer thickness. Another measuring apparatus, however, may be used as long as the measuring principle is the same as that.

The layer thickness at the edge portion of coated layer is measured as follows by a continuous layer thickness measuring method.

The layer thickness is continuously measured by scanning at one edge of the photosensitive layer as displayed in FIG. 1(*c*). The measuring length L, including two parts of the coated layer containing the image forming area and a part of the electroconductive support, is, for example, approximately 5 mm even though which may be different depending on the length of the electroconductive support.

The measurement is carried out at four positions each making a right angle on the cross section of the cylindrical electroconductive support the same as in FIG. 1(*b*), and the measured data are average to obtain an average profile as shown in FIG. 2. $P_{max}$ and D are calculated from the average profile. Moreover, the measurement and calculation are performed with respect to the other edge of the drum. It is preferable that each of the values at both edge of the drum satisfies the definition of the invention. The measurement is performed by a layer thickness measuring apparatus Surfcom, manufactured by Kosaka Kenkyusho, in the cross section curve mode. The surface layer measuring apparatus Surfcom is used for measurement, but another measuring apparatus may be used as long as the measuring principle is the same as that.

It is not easy practically to provide the coated layer on the surface of the electroconductive support and to completely remove the layer at the both edges thereof so as to expose the surface of the electroconductive support. At the present time, methods for removing the layer by scouring employing a brush or tape impregnated by a solvent have been developed. It is found, however, that a problem rises in such the methods even though they are superior methods.

The edge portion of the coated layer has the shape as shown in the enlarged schematic cross section of FIG. 2 even when the coated layer is removed by scouring by the above methods.

In FIG. 2, the coated layer 2 including the photosensitive layer is coated on the surface of the electroconductive support 1; the $P_{max}$ is the average of the largest thickness of the layer at the out side of the image forming area, occasionally referred to as the image area, and the P is the average layer thickness at the central portion of the drum. The D is the average distance from the position of the $P_{max}$ to the exposed area of the surface of the electroconductive support where the coated layer is completely removed. The unit of the above values is expressed by μm.

As is displayed in FIG. 2, the thickness of the photosensitive layer at the central portion of the drum microscopically shows stable value and has a certain prescribed thickness within the range of from 15 to 50 μm. The thickness is become instable near the removed portion at the edge of the drum by the scouring, and the layer is raised a little to become thick and then gradually thinned as shown in the drawing.

The shape of the layer at the portion removed by the scouring includes various shapes such as the microscopic cross section displayed as reference in FIG. 3. The shape in FIG. 3(*a*) is similar to that described in FIG. 2; the shape in FIG. 3(*b*), the layer thickness is once lowered than the constant thickness between the constant thickness area and the position of $P_{max}$ and is arrived at $P_{max}$ thicker than P, and then gradually thinned; and in the shape in FIG. 3(*c*), there is no portion thicker than P at the edge of the photosensitive layer and the thickness is gradually reduced and finally the surface of the electroconductive support is exposed even though the layer thickness is reduced in a constant rate.

It is not cleared yet that what conditions cause such the various shapes. It has been found that the excessively large variation of the layer thickness or the shape at the edge of the layer causes a problem. Because, accumulation of the toner or the adhesion of coagulated toner particles occurs at such the portion during a prolonged period of use and the peeling off of the coated layer occurs from the portion, which are cause various troubles. Namely, the adhesion of the toner T is seen at the edge portion of the coated layer 2, and it is found that the adhesion is easily caused when the value of $P_{max}$ is larger and the value of $P_{max}/D$ is larger. The shape of the layer at the portion removed by the scouring includes various shapes such as the microscopic cross section displayed as reference in FIG. 3. The shape in FIG. 3(*a*) is similar to that described in FIG. 2; the shape in FIG. 3(*b*), the layer thickness is once lowered than the constant thickness between the constant thickness area and the position of $P_{max}$ and is arrived at $P_{max}$ thicker than P, and then gradually thinned; and in the shape in FIG. 3(*c*), there is no portion thicker than P at the edge of the photosensitive layer and the thickness is gradually reduced and finally the surface of the electroconductive support is exposed even though the layer thickness is reduced in a constant rate.

It is not cleared yet that what conditions cause such the various shapes. It has been found that the excessively large variation of the layer thickness or the shape at the edge of the layer causes a problem. Because, accumulation of the toner or the adhesion of coagulated toner particles occurs at such the portion during a prolonged period of use and the peeling off of the coated layer occurs from such the portion, which are cause various troubles. Namely, the adhesion of the toner T is seen at the edge portion of the coated layer 2, and it is found that the adhesion is easily caused when the value of $P_{max}$ is larger and the value of $P_{max}/D$ is larger.

Figure 5:
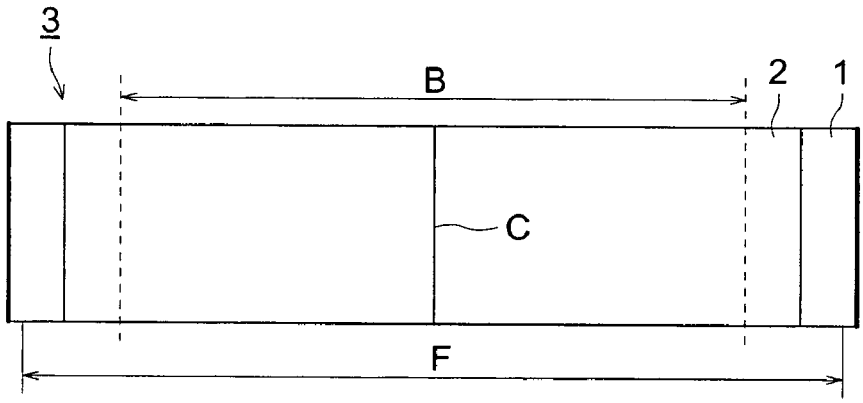
FIG. 5 is a drawing displaying the cleaning area of the photoreceptor drum.

The reason of the above can be easily understood by considering the cleaning range displayed in FIG. 5. In the photoreceptor drum, the coating layer 2 is coated on the electroconductive support 1, and in the coated layer, the area to be used for image formation (image forming area) B is the range directly touching or facing to the magnetic brush of the developing device. The area to be subjected to the cleaning is the area F touched with a cleaning member which is a cleaning blade in many cases. The area B is within the area where the effect of the layer thickness variation is not appeared, and the area F includes the area where the photosensitive layer is not completely removed. The photosensitive layer on the photoreceptor drum is wider than the area B and narrower than the area F. Therefore, the layer is coated until a position between the area B and the area F. As above-described, the edge of the coated layer is influenced by the removing of the photosensitive layer so that the thickness of the layer is locally varied and instable. The adhered amount of the toner is increased accompanied with increasing of the local variation of the layer thickness; and the layer at such the portion tends to be peeled off by the stress caused by the cleaning blade. Thus, problems tend to occur. C is the central portion of the electrophotographic photoreceptor drum.

This situation is the same as to the charging roller and the charging brush. Such the situation can be easily understood by replacing the above-mentioned cleaning blade by the charging roller and the charging brush.

Usually, $P_{max}$ is from 10 to 60 μm, and P is from 15 to 35 μm. The value of $(P_{max}/D)\times100$ is preferably made to from 2 to 50%. When $P_{max}$ is 60 μm or less, the layer is difficultly peeled and the image defect is difficultly caused since the peeled powder is difficultly adhered to the image area. The coated layer is easily removed when $(P_{max}/D)\times100$ is set at a value not less than 2%; that is advantageous for the production. When $(P_{max}/D)\times100$ is not more than 50%, the toner contamination is low and the adhesiveness at the edge portion is improved.

However, the method possible to stably remove the coated layer on the photoreceptor drum so as to be within the above range is the method by the tape and that by the brush, even though there is no specific limitation on the coated layer removing method for satisfying the above condition. The methods are described below.

As the means for controlling the state of the edge so as to be within the above range, the material of tape, the touching condition of tape, the edge shape of tape, the material of brush, the composition of solvent, the time for scouring and the swelling state of coated layer before removing are utilizable. Among them, the controlling by the swelling state of coated layer before removing, the touching condition of tape, the material of brush and the selection of the kind of solvent is relatively easily applied.

Examples of the solvent usable for removing the edge portion of the coated layer include an ether, an alcohol, a chlorinated solvent and a ketone such as tetrahydrofuran, methanol, chloroform, methylene chloride, methyl ethyl ketone (MEK) and acetone and a mixture thereof.

The embodiment of the removing method is described below referring the drawings

1. Removing Method by the Wiping Tape

Figure 6:
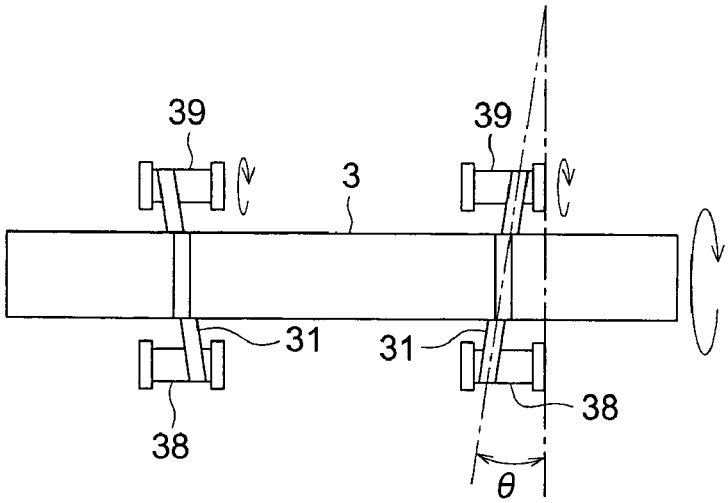
FIG. 6 is a schematic drawing displaying the scouring tape set to the photoreceptor drum with a tilt.

FIG. 6 displays the scheme of the wiping tape set at the photoreceptor drum for making an angle θ larger than 0°.

In FIG. 6, 31 is the wiping tape, 3 is the photoreceptor drum, 38 is a let out roll, 39 is a take up roll and θ is the tilt angle. The arrow indicates the rotating direction.

The edge of the coated layer can be made smooth without formation of burrs by touching the wiping tape to the edge portion of the photoreceptor drum so that the running direction of the tape is tilted to make an angle θ larger than 0° with the surface perpendicular to the length direction of the photoreceptor drum as shown in FIG. 6 since the contacting points of the wiping tape to the section of the coated layer is reduced and the dissolved coated layer can be wiped off so that the dissolved composition is not solidified. The preferable tilting angle of the tape is more than 0° and less than 40°. The possibility of the occurrence of the layer peeling from the edge portion and that of damage on the edge portion of the cleaning blade can be reduced by smoothing the edge of the coating layer.

<Wiping Tape>

As the material of the wiping tape, one capable of being impregnated by the solvent to be employed is preferably usable. The material can be employed without any limitation as long as the material is not corroded by the solvent to be employed and endurable to the tension on the occasion of wiping. Examples of the usable material include synthesized fibers, for example, polyamide fibers such as Nylon 6 fiber and Nylon 66 fiber, polyester fibers such as poly(ethylene terephthalate) fiber and poly(butylene terephthalate) fiber, acryl fiber, vinylon fiber, vinylidene fiber, polyurethane fiber, fluorinated fiber, aromatic polyamide fiber, olefin fibers such as polyethylene fiber and polypropylene fibber; reproduced celluloses such as rayon; semi-synthesized fibers such as acetate fiber, inorganic fibers such as carbon fiber, vegetable fibers such as cotton fiber and linen fiber, and animal fibers such as wool fiber.

<Impregnating Solvent>

As the impregnating solvent to be impregnated into the wiping tape, the foregoing ones can be employed without any limitation even though it may be varied according to the kind of the coating layer as long as the solvent can be removed the coated layer by dissolving or swelling.

The wiping method is performed by a method by touching the wiping tape impregnated with the solvent capable of dissolving or swelling the coated layer to the rotating photoreceptor drum to wipe off the coated layer.

Although the moving direction of the wiping tape is not particularly limited, the direction reverse to the rotation direction of the photoreceptor drum is preferred since the coated layer can be wiped off for shorter time.

Figure 7:
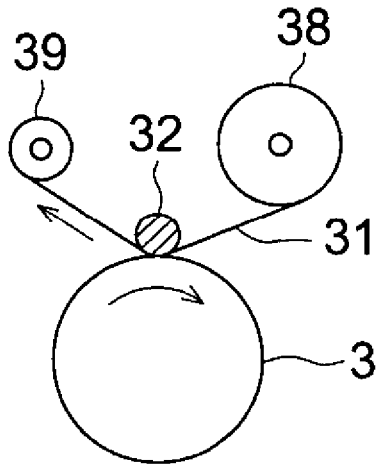
FIGS. 7(*a*) to 7(*c*) each is a schematic drawing displaying an example of the method for contacting the scouring tape to the photoreceptor drum.
Figure 7:
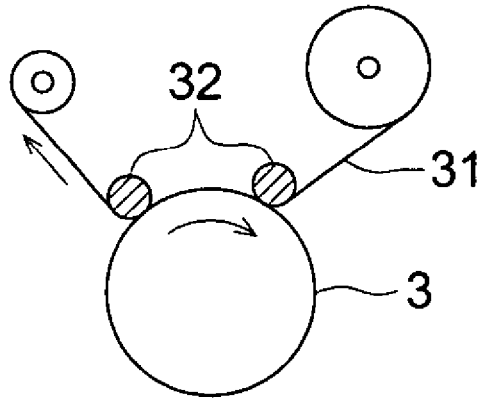
Figure 7:
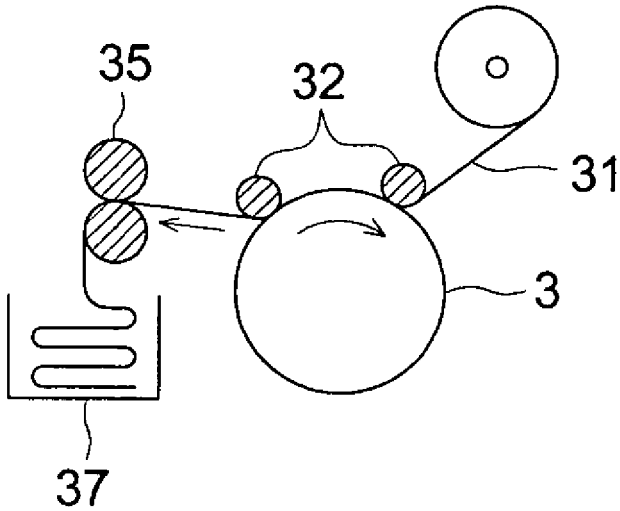

FIG. 7 is a schematic drawing displaying an example of the method for touching the wiping tape to the photoreceptor drum.

The concrete method for touching the wiping tape to the edge of the coated layer on the photoreceptor drum includes those displayed in FIGS. 7(*a*), 7(*b*) and 7(*c*).

FIG. 7(*a*) shows a method in which tension is applied to the wiping tape 31 between the let out roll 38 and the take up roll 39 and the tape is contacted by pressure to the photoreceptor drum by a pressing roller 32. For making the tilt angle of the running direction of the wiping tape to the angle θ larger than 0°, the angle can be optionally set by relatively staggering the position of the let out roll and that of the position of the take up roll as shown in FIG. 6.

FIG. 7(*b*) displays a method in which the wiping tape is contacted to the photoreceptor drum 31 by two pressure rollers 32.

FIG. 7(*c*) displays a method in which the take up roll 39 in FIG. 7(*a*) is replaced by a nip-driving roller 35 and the wiping tape after the wiping is recovered into a recovering container 37. The wiping tape after the wiping contains the solvent. Therefore it is preferable that the tape 31 is recovered into the container 37 since the possibility of the evaporation of the solvent in the room can be inhibited.

2. Removing by the Brush

Figure 8:
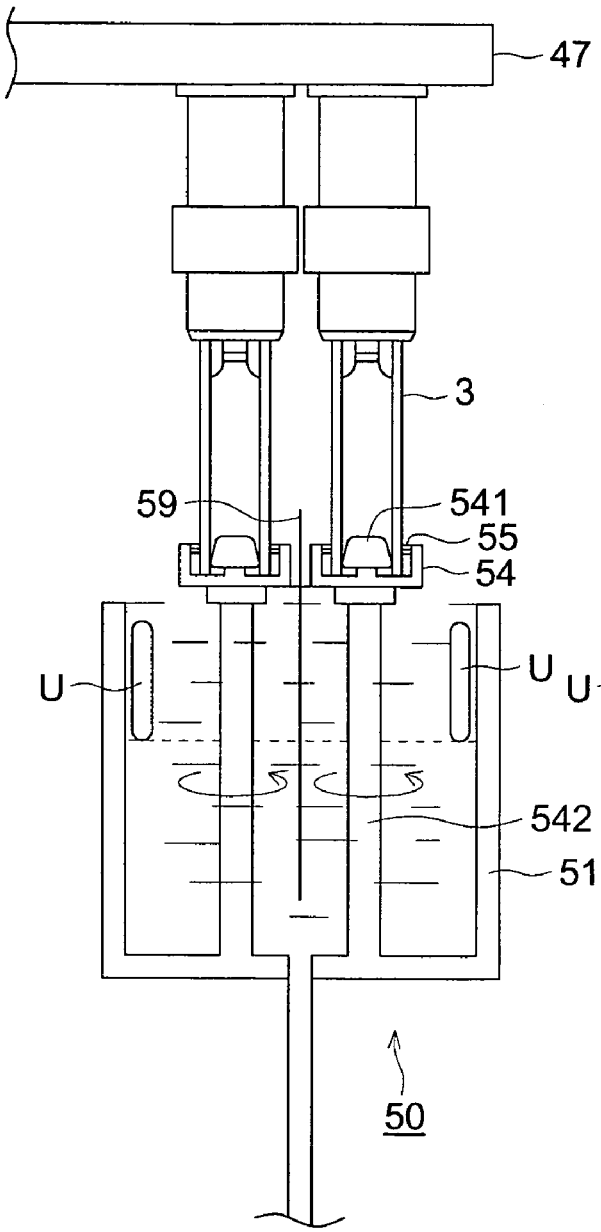
FIGS. 8(*a*) and 8(*b*) each is a cross section of a coated layer removing apparatus by a brush.
Figure 8:
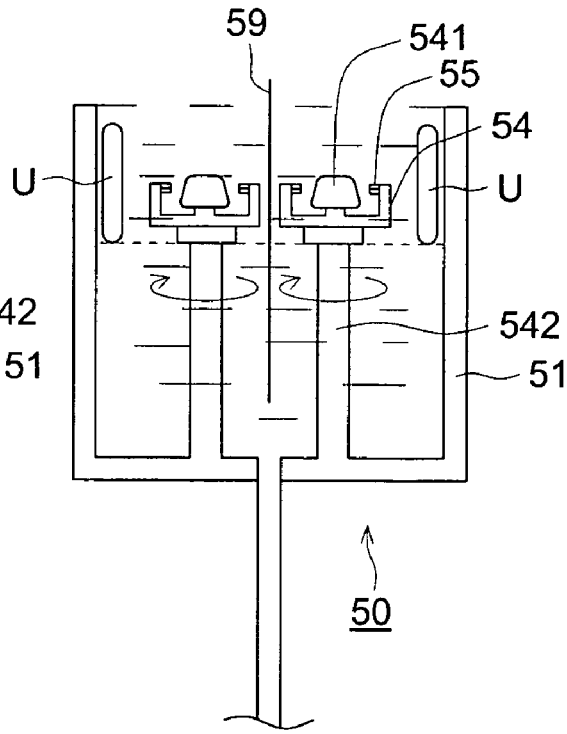

FIG. 8 is the cross section of the coating layer removing apparatus by the brush. In the drawing, 3 is the photoreceptor drum, on the surface thereof the coated layer is formed. The photoreceptor drum is held movably in up and down direction by a conveying means 47 and touched to a scouring member 55 provided to a coated layer removing stand (a coating layer removing means) 54 of the coated layer removing apparatus 50. A support holding member 541 of sponge is provided on the coated layer removing stand 54, and the support 3 is held by the support holding member and the scouring member. The support holding stand 54 is designed so that the stand can be rotated by a driving motor. The photoreceptor drum 3 is stood on the coating layer removing stand 54 by the conveying means 47 having a holding means such as an O-ring chuck and an air picker chuck for holding the interior of the support, and the lower end of the photoreceptor drum 3 is touched to the scouring member 55, cf. FIG. 8. On this occasion, the coated layer removing stand 54 is outside of the liquid surface of a solvent tank 51 as the washing means. The coated layer removing stand 54 is rotated when the remaining solvent in the coated layer at the edge portion of the photoreceptor drum is become to not more than 60%, and the coated layer at the lower end portion of the drum is wiped off by the scouring member 55 accompanied with the rotation of the stand. The remaining amount of the solvent is preferably from 3 to 60% by weight. The remaining solvent amount is percent by weight of the solvent remaining in the coated layer when the solvent amount in the coated layer just after the formation of the layer is defied as 100%, when plural layers are coated, the solvent amount just after the formation of the last layer is defined as 100%.

After finish of the wiping, the photoreceptor drum is lifted up by the conveying means 47, which is also functioned as a separating means, so as to be separated from the coated layer removing stand 54. Thereafter, the coated layer removing stand 54 is immersed into the solvent in the solvent tank 51, as is shown in FIG. 8(*b*), by the rotation of a cylinder 542 as a means for moving the coated layer removing means by which the up and down motion of the coated-layer removing stand is made possible. The coated layer removing stand including the scouring means is entirely washed in the solvent tank by the combination of an ultrasonic cleaner and the up and down motion and the rotating motion of the coating layer removing stand. After that, the coated layer removing stand is lifted again to above the liquid surface of the solvent tank 51 by the rotation of the cylinder 542 to prepare the next removing operation of the coated layer. It is preferable that an ultrasonic vibrating element U is provided in the solvent tank to enhance the cleaning effect of the coated layer removing means. When remove of the coated layers of two or more drums are simultaneously carried out, it is preferable that a partition 59 is provided between each the coated layer removing means as is shown in FIG. 8 to prevent formation of defects caused by splashing of the liquid during the coated layer removing treatment of the each photoreceptor drums.

As the materials of the scouring member, a brush, sponge, cloth and polymer fiber cloth are usable, and the brush is preferred. Nylon, polyethylene, polypropylene, and polyester are suitable as the material of the brush. The size of a hole for providing the fiber of the brush is approximately from 0.5 to 2 mm, and the interval of the holes is approximately from 1 to 3 mm. The entire width of the brush is preferably decided corresponding to the width of the coated layer to be removed.

In the invention, the scoring member impregnating the solvent may be one carrying the solvent if it is not impregnated by the solvent. The impregnating amount of the solvent in the scouring member is preferably that the weight of the scouring member impregnate by the solvent is from 105 to 200 parts by weight when the weight of the dried scouring member is defined as 100 parts.

Figure 9:
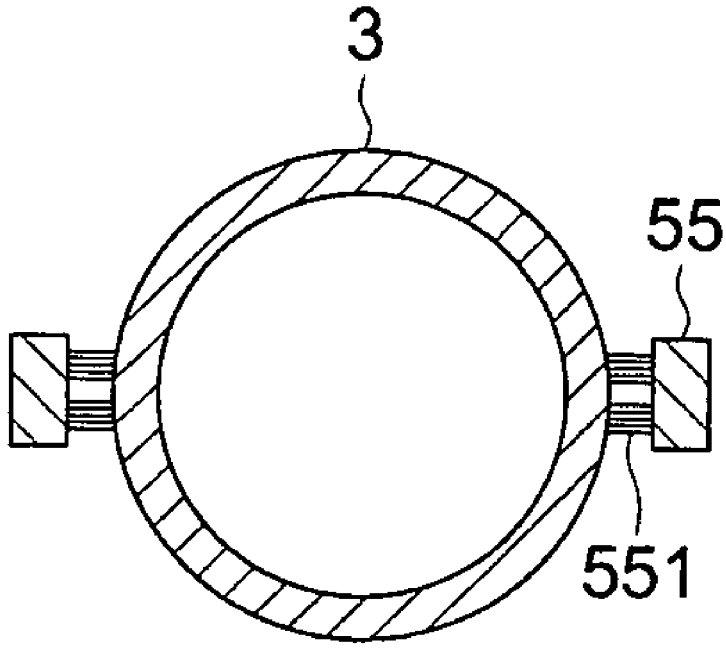
FIG. 9 is a cross section displaying the contacting status of the scouring tape to the photoreceptor drum.

FIG. 9 is a cross section displaying the contacting situation of the scouring member to the photoreceptor drum 3. The photoreceptor drum 3 is contacted to the brush 551 of the scouring member.

Figure 11:
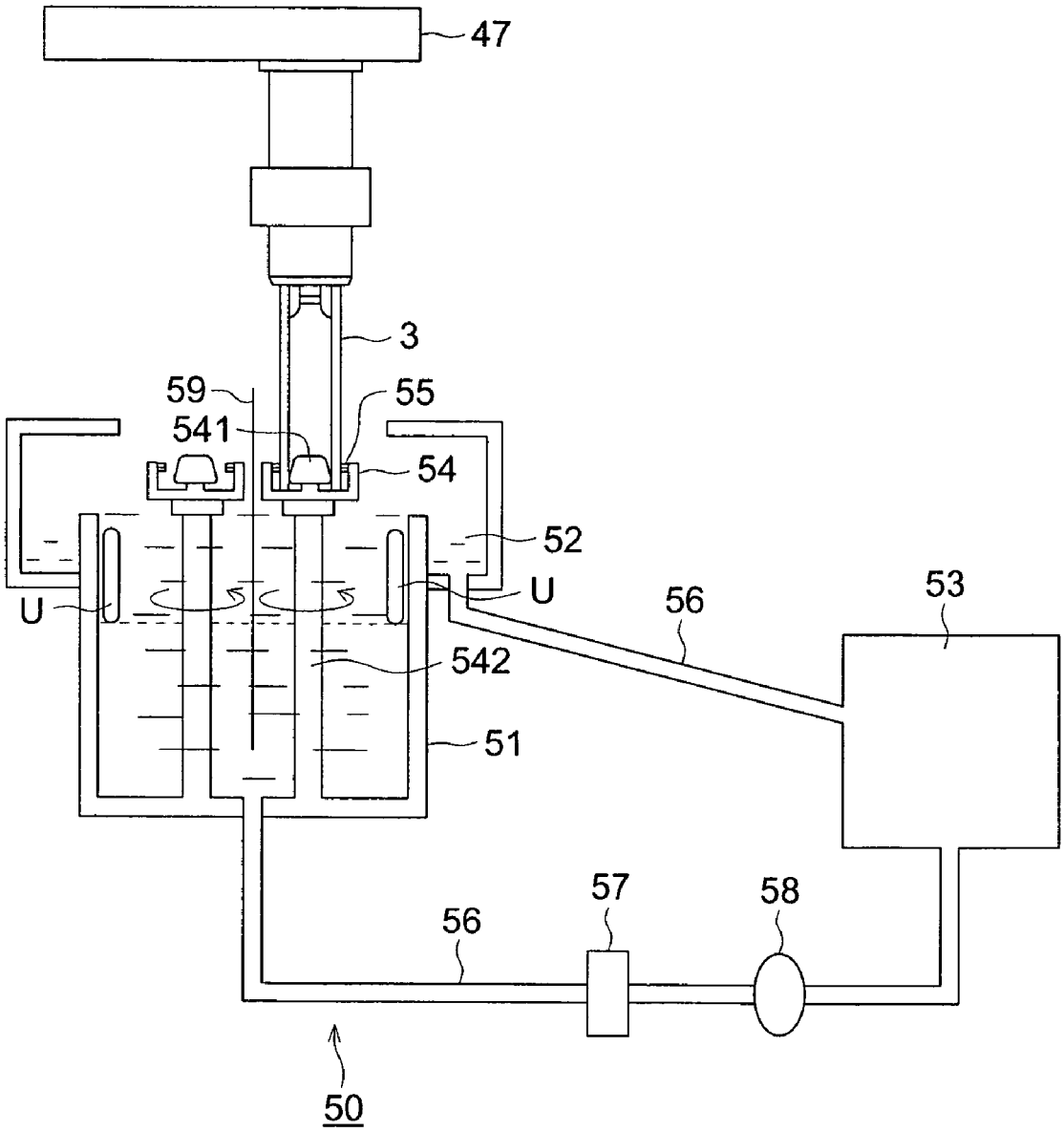
FIG. 11 is entirely constitution schema of an example of the coated layer removing apparatus.

FIGS. 10(*a*) to 10(*c*) each display a form of the scouring member 55. FIG. 11 is the entire construction drawing of the coated layer removing apparatus.

The coated layer removing apparatus 55 is constituted by the solvent tank 51, an overflowed solvent recovering chamber 52, a supplying tank 53, the coated layer removing chamber 54, the scoring member 55, a solvent circulation pipe 56, a pump 57, a filter 58 and the conveying means 47.

The scouring member 55 and a support holding member 541 are attached to the coated layer removing stand 54, and the scouring member is rotated accompanied with rotation of the coated layer removing stand 54 at the same time of the fixation of the support(a) so as to wipe off the coated layer at the lower end of the photoreceptor. As is shown in FIG. 11, the coated layer removing stand 54 is designed so that the coated layer removing stand is movable from or into the solvent tank 51 together with the scouring member 55 by the rotation of the cylinder 542.

The solvent in the solvent tank is usually circulated through the circulation pipe 56 and the components of the coated layer is removed by a filter provided at the half way of the circulations pipe so that the coated layer removing means can be sufficiently washed.

U in FIGS. 8(*a*), 8(*b*) and 11 is the ultrasonic generation device.

Next, the photoreceptor is described below.

Support (Substrate)

As the substrate of the photoreceptor, a cylindrical electroconductive support is employed. The cylindrical electroconductive support is a cylindrical support capable of endlessly forming an image by rotating; and the electroconductive support having a straightness of not more than 0.1 mm and a deviation of not more than 0.1 mm is preferred. When the straightness and the deviation exceed the above range, a fine image is difficultly obtained.

As the electroconductive material support, a drum of metal such as aluminum and nickel, a plastic drum evaporated with aluminum, tin oxide or indium oxide, and a paper or plastic drum each coated by an electroconductive substance are usable. The electroconductive support having a specific resistance of not more than $10^3$ Ωcm is preferable.

An endless belt can be used as the substrate. As the material of such the substrate, known materials such as polyamide, polyester and an electroformed nickel film are usable. An electroconductive layer is provided when the endless belt is an insulator.

Intermediate Layer

In the photoreceptor, the intermediate layer is provided between the support and the photosensitive layer to improve the adhesiveness between the support and the photosensitive layer and to prevent the injection of electron from the support. As the material of the intermediate layer, polyamide resin, vinyl chloride resin, vinyl acetate resin, and copolymer resin containing at least two kinds of the repeating unit of the above-mentioned resins are usable. Among the above resins, polyamide resin is preferred since increasing of the remaining potential accompanied with repeating use of the photoreceptor can be reduced. The thickness of the intermediate layer employing such the resins is preferably from 0.01 to 2.0 μm.

Preferable intermediate layer includes one employing a hardenable metal resin which is prepared by thermally hardening an organic metal compound such as a silane coupling agent and a titanium coupling agent. The thickness of the intermediate layer employing the hardenable metal resin is preferable from 0.01 to 2.0 μm.

Another preferable intermediate layer is one composed of a binder resin and titanium oxide dispersed in the binder resin. The thickness of the intermediate layer employing the titanium oxide is preferable from 0.1 to 15 μm.

Preferable constitution of the photosensitive layer of the organic photoreceptor is described below.

Photosensitive Layer

The photosensitive layer of the photoreceptor is preferably constituted by a charge generation layer (CGL) and a charge transfer layer (CTL) each separated according to the functions thereof even though a single layer constitution having both of the charge generation and the charge transfer functions may be applied. The increasing of the remaining potential accompanied with repeating use can be inhibited and the electrophotographic properties can be easily controlled by employing the function separated layer constitution. For the photoreceptor to be negatively charged, it is preferable that the photoreceptor is constituted by the charge generation layer (CGL) provided on the subbing layer and the charge transfer layer (CTL) provided on the charge generation layer. For the photoreceptor to be positively charged, the layers are arranged in the order of the intermediate layer, CTL and CGL. The most preferable photoreceptor constitution is the negatively chargeable constitution having the foregoing function separated constitution.

The layer constitution of the negatively chargeable photoreceptor is described below.

As the charge generation substance, known phthalocyanine compounds can be used. Preferable compounds are a titanylphthalocyanine compound and a hydroxygallium phthalocyanine compound. Y-type and A-type (β-type) phthalocyanine, and a phthalocyanine compound characterized by a principal peak of Bragg's angle 2θ of Cu-κα characteristic X-ray with a wavelength of 1.54 Å are useful. Such the kinds of oxytitanylphthalocyanine are described in Japanese Patent Publication Open to Public Inspection No. 10-069107. These charge generation substances may be used solely or in a combination of two or more kinds of them such as a mixture of the A-type and B-type, or a combination with polycyclic quinine such as perylene.

As the binder resin of the charge generation layer, known resins may be used. Listed as the binder resin are polystyrene resin, polyethylene resin, polypropylene resin, acryl resin, methacryl resin, vinyl chloride resin, vinyl acetate resin, poly (vinyl butyral) resin, epoxy resin, polyurethane resin, phenol resin, polyester resin, alkyd resin, polycarbonate resin, silicone resin, melamine resin, a copolymer including two or more kinds of repeating unit of the above resins such as vinyl chloride-vinyl acetate copolymer and vinyl chloride-vinyl acetate-maleic anhydride copolymer, and polyvinylcarbazole. However, the usable resin is not limited to the above-described.

The charge generation layer preferable formed by the following procedure: A coating liquid is prepared by dispersing the charge generation substance in a solvent solution of the binder resin by a dispersing machine, and the coating liquid is coated as a layer having a uniform thickness by a coating apparatus, and then dried.

As the solvent to dissolve the binder resin to be used in the charge generation layer, the followings are cited: for example, toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1,4-dioxane, pyridine and diethyl amine. However, the solvent is not limited to the above-described.

For dispersing the charge generation substance, an ultrasonic dispersing apparatus, a ball mill, a sand grinder and a homomixer are usable, but the dispersing means is not limited to them.

As the coating apparatus for coating the charge generation layer, an immersion coater and a ring coater are usable, but the coating means is not limited to them.

The mixing ratio of the charge generation substance to the binder resin is preferably from 1 to 600 parts, and more preferably from 50 to 500 parts, by weight to 100 parts by weight of the binder resin. The thickness of the charge generation layer is preferably from 0.01 to 5 μm, even though the thickness is varied depending on the property of the charge generation substance, that of the binder resin and the mixing ratio.

<Charge Transfer Layer>

The charge transfer layer contains a charge transfer substance and a binder resin, and is formed by coating a solution of charge transfer substance dissolved in a binder solution.

As the charge transfer substance are those represented by the formula disclosed in Japanese Patent Application No. 2000-360998, carbazole derivatives, oxazole derivatives, oxadiazole derivatives, thiazole derivatives, thiadiazole derivatives, triazole derivatives, imidazole derivatives, imidazolone derivatives, imidazolidine derivatives, bis-imidazolidine derivatives, styryl compounds, hydrazone compounds, pyrazoline compounds, oxazolone derivatives, benzimidazole derivatives, quinazoline derivatives, benzofuran derivatives, acrydine derivatives, phenadine derivatives, aminostilbene derivatives, triarylamine derivatives, phenylenediamine derivatives, stilbene derivatives, benzidine derivatives, poly-N-vinylcarbazole, poly-1-vinylpyrene and poly-9-vinylanthracene are usable, they may be used in combination of two or more kinds of them.

As the binder resin for the charge transfer layer, known resins can be used. Examples of the resin include polycarbonate resin, polyacrylate resin, polyester resin, polystyrene resin, styrene-acrylonitrile copolymer resin, polymethacrylate resin, and styrene-polymethacrylate resin. Polycarbonate resin is preferred. Polycarbonate resin such as BPA, BPZ, dimethyl BPZ and BPA-dimethyl BPA copolymer is preferred from the viewpoint of cracking resistivity, anti-frictional wearing and anti-static property.

The charge transfer layer preferable formed by the following procedure: A coating liquid is prepared by dissolving the charge transfer substance and the binder resin, and the coating liquid is coated as a layer having a uniform thickness by a coating apparatus, and then dried.

As the solvent for dissolving the binder resin and the charge transfer substance, for example, toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine and diethylamine are usable.

The mixing ratio of the charge transfer substance to the binder resin is preferably from 10 to 500 parts, and more preferably from 20 to 100 parts, by weight to 100 parts by weight of the binder resin. The thickness of the charge transfer layer is preferably from 10 to 100 μm, and more preferably from 15 to 40 μm, even though the thickness is varied depending on the property of the charge transfer substance, that of the binder resin and the mixing ratio.

An antioxidant (AO agent), an electron acceptable substance (EA agent) and a stabilizing agent may be added into the charge transfer layer. The AO agent described in Japanese Patent Application No. 11-200135, and the EA agent described in Japanese Patent O.P.I. Publication Nos. 50-137543 and 58-76483 are useful.

<Protective Layer>

A protective layer may be provided on the charge transfer layer to improve the durability. The protective layer employing a siloxane resin described in Japanese Patent O.P.I. Publication Nos. 9-190004, 10-095787 and 2000-171990 is preferred which improves the anti-wearing property. Although an example of the most preferable layer constitution in the invention is described in the above, another layer constitution may be applied in the invention.

The organic photoreceptor is described in the above, but it is not intended to exclude an inorganic photoreceptor, typically amorphous silicone, from the subject of the invention.

Next, the image forming apparatus employing the photoreceptor drum is described which is prepared by the manufacturing method according to the invention.

[2] Toner for Developing a Static Latent Image

The toner for developing a static latent image according to the invention is described below.

1. The Diameter and it Distribution of the Toner to be Used in the Invention, Hereinafter Referred to as the Toner The volume diameter, number diameter and the ratio of the volume diameter to the number diameter are described below.

From the viewpoint of obtaining the effects described in the invention, the toner according to the invention is preferably monodispersed in terms of particle size distribution. Further, it is preferable that the ratio (Dv50/Dp50) of the 50 percent volume particle diameter (Dv50) to the 50 percent number particle diameter (Dp50) of the toner is from 1.0 to 1.15. Said ratio is preferably from 1.0 to 1.13.

Further, in order to control the variation range of transferability as well as developability, the ratio (Dv75/Dp75) of the cumulative 75 percent volume particle diameter (Dv75) from the largest particle diameter to the cumulative 75 percent number particle diameter (Dp75) from the largest particle diameter is preferable to be from 1.0 to 1.20, and is preferably from 1.1 to 1.19. In addition, the ratio of toner particles having a number particle diameter of less than or equal to 0.7.times.(Dp50) is preferable to be 10 percent by number or less based on the total number of toner particles, and is preferably from 5 to 9 percent by number.

The 50 percent volume particle diameter (Dv50) of the toner is preferably from 2 to 8 μm, and is more preferably from 3 to 7 μm. Further, the 50 percent number particle diameter of the toner according to the invention is preferably from 2 to 7.5 μm, and is more preferably from 2.5 to 7 μm. By adjusting said diameter to said range, the effects of the preset invention are more markedly exhibited.

Further, in the invention, when a plurality of toners is employed, it is preferable that at least one of the toners, but it is preferable that all the toners, satisfy the aforesaid requirements, namely the ratio (Dv50/Dp50) of the 50 percent volume particle diameter (Dv50) to the 50 percent number particle diameter (Dp50) is from 1.0 to 1.15; the ratio (Dv75/Dp75) of cumulative 75 percent volume particle diameter (Dv75) from the largest particle diameter of toner to the cumulative 75 percent number particle diameter (Dp75) from the largest particle diameter of said toner is from 1.0 to 1.20; the ratio of toner particles having a number particle diameter of less than or equal to 0.7.times.(Dp50), is 10 percent by number or less, based on the total number of toner particles.

The cumulative 75 percent volume particle diameter (Dv75) or the cumulative 75 percent number particle diameter (Dp75), as described herein, refers to the volume particle diameter or the number particle diameter, each of which is 75 percent with respect to the sum of the total volume or the sum of the total number while accumulating the frequency from the largest particle diameter.

The 50 percent volume particle diameter (Dv50), 50 percent number particle diameter (Dp50), cumulative 75 percent volume diameter (Dv75), and cumulative 75 percent number particle diameter can be determined employing a COULTER COUNTER TYPE TA-II or a COULTER MULTISIZER (both manufactured by Coulter Co.).

The components of the electrostatic image developing toner and the components of binding resins which constitute said toner according to the invention, as well as those of these productions, will now be described.

The toner comprises at least a coloring agent as well as a binding resin. Said toner may be produced employing processes such as pulverization and classification, or employing a so-called polymerization method in which toner is prepared employing resinous particles prepared by polymerizing polymerizable monomers as described below. When said toner is prepared employing said polymerization method, a production method is particularly preferred which comprises a process in which resinous particles are subjected to salting-out/fusion.

Polymerizable monomers employed in the polymerization method comprise radical polymerizable monomers as a component, and if desired, crosslinking agents may be employed. Further, it is preferable that at least one of said radical polymerizable monomers, having an acidic group or a basic group shown below, is incorporated.

(1) Radical Polymerizable Monomers

Radical polymerizable monomer components are not particularly limited and several of the conventional radical polymerizable monomers may be employed. They may be used individually or in combination so as to satisfy the desired characteristics.

Specifically listed are aromatic based vinyl monomers, acrylic acid ester based monomers, methacrylic acid ester based monomers, vinyl ester based monomers, vinyl ether based monomers, monoolefin based monomers, diolefin based monomers, and halogenated olefin based monomers.

Listed as aromatic based vinyl monomers are, for example, styrene based monomers and derivative thereof such as o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Listed as acrylic acid or methacrylic acid ester based monomers are methyl acrylate, ethyl acrylate, butyl acrylate, 2-ethylhexyl-acrylate, cyclohexyl acrylate, phenyl acrylate, methyl methacrylate, ethyl methacrylate, butyl methacrylate, hexyl methacrylate, 2-methylphenyl methacrylate, ethyl β-hydroxyacrylate, propyl γ-aminoacrylate, stearyl methacrylate, dimethylaminoethyl methacrylate, and diethylaminoethyl methacrylate.

Listed as vinyl ester based monomers are vinyl acetate, vinyl propionate, and vinyl benzoate.

Listed as vinyl ether based monomers are vinyl methyl ether, vinyl ethyl ether, vinyl isobutyl ether, and vinyl phenyl ether.

Listed as monoolefin based monomers are ethylene, propylene, isobutylene, 1-butene, 1-pentene, and 4-methyl-1-pentene.

Listed as diolefin based monomers are butadiene, isoprene, and chloroprene.

Listed as halogenated olefin based monomers are vinyl chloride, vinylidene chloride, and vinyl bromide.

(2) Crosslinking Agents

In order to improve the characteristics of toner, as added crosslinking agents are radical polymerizable crosslinking agents. Listed as crosslinking agents are those having at least two unsaturated bonds such as divinylbenzene, divinylnaphthalene, divinyl ether, diethylene glycol methacrylate, ethylene glycol dimethacrylate, polyethylene glycol dimethacrylate, and diallyl phthalate.

(3) Polymerizable Monomers Having an Acidic Group or a Basic Group

Listed as polymerizable monomers having an acidic group or a basic group are, for example, polymerizable monomers having a carboxyl group, polymerizable monomers having a sulfonic acid group, and primary amine, secondary amine, tertiary amine and quaternary amine based polymerizable monomers.

Listed as polymerizable monomers having a carboxyl group are acrylic acid, methacrylic acid, fumaric acid, maleic acid, itaconic acid, cinnamic acid, monobutyl maleate ester, and monooctyl maleate ester.

Listed as polymerizable monomers having a sulfonic acid group are styrenesulfonic acid, allylsulfosuccinic acid, and octyl allyl sulfosuccinate.

These compounds may have a structure of salts of alkali such as sodium and potassium, or salts of alkali earth metals such as calcium.

Listed as radical polymerizable monomers having a basic group are amine based compounds which may include dimethylaminoethyl acrylate, dimethylaminoethyl methacrylate, diethylaminoethyl acrylate, diethylaminoethyl methacrylate, and quaternary ammonium salts of the 4 compounds described above; and 3-diethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; vinylpyridine, vinylpyrrolidone; vinyl N-methylpyridinium chloride, vinyl N-ethylpyridium chloride, N,Ndiallylmethylammonium chloride, and N,N-diallylethylammonium chloride.

Regarding the radical polymerizable monomers employed in the invention, the radical polymerizable monomers having an acidic group or a basic group are preferably employed in an amount of 0.1 to 15 percent by weight based on the total of said monomers. Radical polymerizable crosslinking agents are preferably employed in an amount of 0.1 to 10 percent by weight based on the total radical polymerizable monomers, even though said amount may vary depending on their characteristics.

(Chain Transfer Agents)

With the purpose of adjusting the molecular weight, commonly employed chain transfer agents may be used. Chain transfer agents are not particularly limited, and for example, octylmercaptan, dodecylmercaptan, tert-dodecylmercaptan, n-octyl-3-mercaptopropionic acid ester, carbon tetrabromide, and styrene dimer, may be employed.

(Polymerization Initiators)

Radical polymerization initiators, employed in the invention, when they are water-soluble, may be suitably employed. Listed as said initiators are, for example, persulfate salts (potassium persulfate and ammonium persulfate), azo based compounds (4,4'-azobis-4-cyanovaleric acid and salts thereof, and 2,2-azobis(2-aminodipropane) salts), and peroxides.

Further, if desired, said radical polymerization initiators may be combined with reducing agents and used as redox based initiators. By employing said redox based initiators, polymerization activity increases whereby it is possible to lower polymerization temperature, and a decrease in polymerization time can be expected.

Selected as said polymerization temperature may be any reasonable temperature, as long as it is higher than or equal to the lowest radical forming temperature. For example, the temperature range of 50 to 90 degree C. is employed. However, when polymerization initiators, which work at normal temperature are employed in combination, such as a combination of hydrogen peroxide and a reducing agent (ascorbic acid), it is possible to carry our polymerization at temperature equal to or higher than room temperature.

(Surface Active Agents)

In order to carry out polymerization while using said radical polymerizable monomers, it is necessary to carry out oil droplet dispersion into a water-based medium, employing surface active agents. Surface active agents, which can be employed during said dispersion, are not particularly limited. Listed as suitable examples may be the ionic surface active agents shown below.

Listed as ionic surface active agents are sulfonates (sodium dodecylbenzenesulfonate, sodium arylalkyl polyether sulfonate, sodium 3,3-disulfonediphenyurea-4,4-diazo-bis-amino-8-naphthol-6-sulfonate, and sodium ortho-carboxybenzene-azo-dimethylaniline-2,2,5,5-tetramethyltriphenylmath ane-4,4-diazo-bis-.beta.-naphthol-6-sulfonate), sulfate esters (sodium dodecylsulfate, sodium tetradecylsulfate, sodium pentadecylsulfate, and sodium octylsulfate), and fatty acid salts (sodium oleate, sodium laurate, sodium caprate, sodium caprylate, sodium caproate, potassium stearate, and calcium oleate).

Further, nonionic surface active agents can also be employed. Specifically listed as such are polyethylene oxide, and polypropylene oxide, a combination of polypropylene oxide with polyethylene oxide, esters of polyethylene glycol with higher fatty acids, alkylphenol polyethylene oxide, esters of polyethylene glycol with higher fatty acid, and esters of polypropylene oxide with higher fatty acids.

In the invention, these are mainly employed as an emulsifier during emulsion polymerization, but may be employed in other processes or to achieve other purposes.

(Coloring Agents)

Listed as coloring agents may be inorganic pigments, organic pigments and dyes.

Employed as said inorganic pigments may be any of the several conventional ones known in the art. Specific inorganic pigments will be exemplified below.

Employed as black pigments may be, for example, carbon blacks such as furnace black, channel black, acetylene black, thermal black, and lamp black, and in addition magnetic powders such as magnetite and ferrite.

If desired, these inorganic pigments may be employed individually or in combination. Further, the content of said pigments is from 2 to 20 percent by weight with respect to the weight of polymers, and is preferably from 3 to 15 percent by weight.

When said inorganic pigments are employed as magnetic toner, it is possible to add said magnetite. In this case, from the viewpoint of providing the specified magnetic characteristics, said magnetite is preferably added to toner in an amount of 20 to 60 percent by weight.

Employed as said organic pigments as well as said dyes may be any of the several conventional ones known in the art. Specific organic pigments as well as specific dyes will be exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, and C.I. Pigment Yellow 156.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Employed as dyes may be C.I. Solvent Red 1, C.I. Solvent Red 49, C.I. Solvent Red 52, C.I. Solvent Red 58, C.I. Solvent Red 63, C.I. Solvent Red 111, and C.I. Solvent Red 122; C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, and C.I. and Solvent Yellow 162; C.I. Solvent Blue 25, C.I. Solvent Blue 36, C.I. Solvent Blue 60, C.I. Solvent Blue 70, C.I. Solvent Blue 93, and C.I. Solvent Blue 95, and these may be employed in combination.

If desired, these organic pigments and dyes may be employed individually or in combination of a plurality of these. The amount of pigments added is commonly from 2 to 20 percent by weight with respect to the weight of polymers, and is preferably from 3 to 15 percent by weight.

Said coloring agents may be subjected to surface modification and subsequently employed. Employed as surface modifying agents may be conventional ones known in the art. Specifically, silane coupling agents, titanium coupling agents, and aluminum coupling agents may be preferably employed.

Toner according to the invention may be employed in combination with releasing agents. For example, employed as releasing agents may be low molecular weight polyolefin waxes such as polypropylene and polyethylene, paraffin waxes, Fischer-Tropsh waxes, and ester waxes. Further, in the invention, ester waxes, represented by Formula (1) given below, may be preferably employed.

$$R^1—(OCO—R^2)_n \qquad \text{Formula (1)}$$

In the above, n is an integer of from 1 to 4, preferably from 2 to 4, more preferably 3 or 4, and further preferably 4. $R^1$ and $R^2$ are each a hydrocarbon group which may have a substituent. The number of carbon atoms of $R^1$ is from 1 to 40, more preferably from 1 to 20, and further preferably 2 to 5. The number of carbon atoms of $R^2$ is from 1 to 40, more preferably from 13 to 29, and further preferably 12 to 25.

Concrete examples of the crystalline compound having an ester group according to the invention are listed below; the invention is not limited to these.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—(CH_2)_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2(O—CO—(CH_2)_{26}—CH_3)—CH(O—CO—(CH_2)_{26}—CH_3)—CH_2(O—CO—(CH_2)_{26}—CH_3)$

11) $CH_2(O—CO—(CH_2)_{22}—CH_3)—CH(O—CO—(CH_2)_{22}—CH_3)—CH_2(O—CO—(CH_2)_{22}—CH_3)$

12) $CH_2(OH)—CH(O—CO—(CH_2)_{26}—CH_3)—CH_2(O—CO—(CH_2)_{26}—CH_3)$

13) $CH_2(OH)—CH(O—CO—(CH_2)_{22}—CH_3)—CH_2(O—CO—(CH_2)_{22}—CH_3)$

14) $CH_2(OH)—CH(OH)—CH_2(O—CO—(CH_2)_{26}—CH_3)$

-continued

15) $CH_2(OH)—CH(OH)—CH_2(O—CO—(CH_2)_{22}—CH_3)$

16) $CH_3—(CH_2)_{26}—COO—CH_2—C(CH_3)(CH_2—O—CO—(CH_2)_{26}—CH_3)_2$

17) $CH_3—(CH_2)_{20}—COO—CH_2—C(CH_2CH_3)(CH_2—O—CO—(CH_2)_{20}—CH_3)_2$

18) $CH_3—(CH_2)_{26}—COO—CH_2—C(CH_2—O—CO—(CH_2)_{26}—CH_3)_3$

19) $CH_3—(CH_2)_{20}—COO—CH_2—C(CH_2—O—CO—(CH_2)_{20}—CH_3)_3$

20) $CH_3—(CH_2)_{18}—COO—CH_2—C(CH_2—O—CO—(CH_2)_{18}—CH_3)_3$

21) $CH_3—(CH_2)_{16}—COO—CH_2—C(CH_2—O—CO—(CH_2)_{16}—CH_3)_3$

22) $CH_3—(CH_2)_{20}—COO—CH_2—C(CH_2—O—CO—CH_3)_3$

These ester waxes are incorporated into resinous particles and function to provide excellent fixability (adhesion properties to the image receiving member) to the toner which has been prepared by fusing resinous particles.

The content ratio of releasing agents employed in the invention is preferably from 1 to 30 percent by weight, based on the weight of all the toners, is more preferably from 2 to 20 percent by weight, and is further more preferably from 3 to 15 percent by weight. Further, the preferred toner of the invention is prepared as described below. Said releasing agents are dissolved in the aforesaid polymerizable monomers, and the resultant solution is dispersed into water. Subsequently, the resultant dispersion undergoes polymerization, and particles are formed in which the ester based compounds, described above as a releasing agent, are incorporated in the resinous particles. Subsequently, said toner is prepared through a process in which the resultant particles are salted out/fused together with said coloring agent particles.

In addition to said coloring agents and releasing agents, materials, which can provide various functions, may be added as toner materials to the toner according to the invention.

Specifically, listed are charge control agents. These components may be added employing various methods such a method in which during the stage of said salting-out/fusion, said components are simultaneously added with said resinous particles as well as said coloring agents so that said components are included in toner particles, and a method in which said components are directly added to said resinous particles.

In the same manner, it is possible to employ various charge control agents, known in the art, and can be dispersed into water. Listed as specific examples are nigrosine based dyes, metal salts of naphthenic acid or higher fatty acids, alkoxylated amines, quaternary ammonium salts, azo based metal complexes, metal salicylates or metal complexes thereof.

External agents employed in the toner according to the invention will now be described.

For the purpose of improving fluidity and chargeability, as well as of enhancing cleaning properties, so-called external additives may be employed via addition to the toner according to the invention. These external additives are not particularly limited, but various fine inorganic and organic particles, as well as slipping agents can be employed.

Employed as fine inorganic particles may be any of the several conventional ones known in the art. Specifically, fine particles of silica, titanium, and alumina may be preferably employed. As said fine inorganic particles, hydrophobic ones are preferred. Listed as specific fine silica particles are commercially available products such as R-805, R-976, R-974, R-972, R-812, and R-809, manufactured by Nippon Aerosil Co.; HVK-2150 and H-200, manufactured by Hoechst Co.; and TS-720, TS-530, TS-610, H-5, and MS-5, manufactured by Cabot Co.

Listed as fine titanium particles are, for example, commercially available products such as T-805 and T-604, manufactured by Nippon Aerosil Co.; MT-100S, MT-100B, MT-500BS, MT-600, MT-600SS, and JA-1, manufactured by Teika Co.; TA-300SI, TA-500, TAF-130, TAF-510, and TAF-510T, manufactured by Fuji Titan Co.; IT-S, IT-OA, IT-OB, and IT-OC, manufactured by Idemitsu Kosan Co.

Listed as fine alumina particles are, for example, communally available products such as RFY-C, manufactured by Nippon Aerosil Co. and TTO-55, manufactured by Ishihara Sangyo Co.

Further, employed as fine organic particles may be spherical ones having a number average primary particle diameter of about 10 to about 2,000 nm. Employed as materials for such fine organic particles may be homopolymers of styrene and methylmethacrylate and copolymers thereof.

Listed as slipping agents are, for example, salts of higher fatty acids such as salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; as well as salts of ricinolic acid with zinc and calcium.

The content ratio of these external additives is preferably from 0.1 to 5 percent by weight with respect to the toner.

Listed as units which are employed to add said external additives are various mixers, known in the art, such as a turbuler mixer, a Henschel mixer, a Nauter mixer, and a V type mixer.

The production method of the electrostatic image developing toner according to the invention will now be described.

<<Production Processes>>

The toner of the invention is preferably produced employing a polymerization method, comprising a process in which a polymerizable monomer solution, in which releasing agents are dissolved, or a dispersion prepared by dispersing a polymerizable monomer solution into a water-based medium undergoes polymerization so that releasing agents are incorporated into resinous particles; a washing process in which the resultant particles are collected from said water-based medium, employing filtration so that surface active agents and the like are removed; a drying process in which the resultant particles are dried; and an external additive adding process in which external additives are added to the particle prepared by drying. Herein, said resinous particles include colored particles. Said colored particles are prepared by fusing resinous particles in a water-based medium to which a coloring agent dispersion has been added.

Specifically, said fusion is preferably carried out employing a method in which resinous particles prepared by said polymerization process are subjected to salting-out/fusion. Further, when non-colored resinous particles are employed, resinous particles and coloring agent particles can be subjected to salting-out/fusion in a water-based medium.

Further, being not limited to said coloring agents and said releasing agents, charge control agents and the like may be added in the form of those particles during said process. Incidentally, the water-based medium, as described herein, refers to a medium comprised of water as a main component in which the content ratio of water is at least 50 percent by weight. Listed as components, other than water, may be water-soluble organic solvents, and include, for example, methanol, ethanol, isopropanol, butanol, acetone, methyl ethyl ketone, and tetrahydrofuran. Of these, alcohol based organic solvents such as methanol, ethanol, isopropanol, and butanol, which preferably do not dissolve said resins, are particularly preferred.

Cited as the preferred polymerization method in the invention may be a method in which a monomer solution, prepared by dissolving releasing agents in said monomers, is dispersed, employing a mechanical device, in the form of oil droplets into a water-based medium in which surface active agents are dissolved at the critical micelle concentration or less, subsequently water-soluble polymerization initiators are added to the resultant dispersion, and the resultant mixture undergoes radical polymerization. In said polymerization, oil-soluble polymerization initiators may be added to said monomers.

Homogenizers to carry out said oil droplet dispersion are not particularly limited. Listed as such homogenizers may be, for example, CLEAR MIX, ultrasonic homogenizers, mechanical type homogenizers, Manton-Gaulin homogenizers, and pressure type homogenizers.

Coloring agents may be subjected to surface modification and then employed. In a surface modification method of coloring agents, said coloring agents are dispersed into solvents, and surface modifying agents are added into the resultant dispersion. The resultant mixture is then heated to result in the desired reaction. After said reaction, the resultant mixture is filtered and the filtrate is repeatedly washed and filtered employing the same solvents, and subsequently dried, whereby a pigment, which has been treated with said surface modifying agents, is obtained.

Said coloring agent particles may be prepared employing a method in which coloring agents are dispersed into a water-based medium. Said dispersion is preferably carried out in such a state that the concentration of a surface active agent in water is adjusted to its critical micelle concentration (CMC) or higher.

Homogenizers employed for dispersing pigments are not particularly limited. Listed as preferred homogenizers are CLEAR MIX, ultrasonic homogenizers, mechanical homogenizers, pressure homogenizers such as Manton-Gaulin and pressure type homogenizers, and medium type homogenizers such as a Getzman mill and a diamond fine mill.

Employed as surface active agents utilized herein may be those previously described.

The process, which carries out salting-out/fusion, is a process in which salting-out agents, comprised of alkali metal salts and alkali earth metal salts, is added as a coagulant, at a critical coagulation concentration or higher, to water in which resinous particles as well as coloring agent particles are present, and subsequently, the resultant mixture is heated to a temperature higher than or equal to the glass transition point of said resinous particles so that salting out and fusion proceed simultaneously. Herein, regarding alkali metal salts and alkali earth metal salts as the salting-out agent, listed as alkali metals are lithium, potassium, and sodium, and listed as alkali earth metals are magnesium, calcium, strontium, and barium. Of these, potassium, sodium, magnesium, calcium and barium are preferably listed. Further, listed as formed salts are chloride salts, bromide salts, iodide salts, carbonate salts, and sulfate salts.

Methods to achieve the desired particle size distribution of toner are not particularly limited. However, employed may be methods utilizing classification, controlling temperature as well as time during coalescence, and in addition, selecting methods to terminate said coalescence.

Listed as the particularly preferred production method is a method to control the coalescence time, the coalescence temperature, and the termination rate in water. Namely, when salting-out/fusion is employed, it is preferable to minimize hold-over time after adding salting-out agents. The reasons have not yet been studied well enough to be fully clarified. However, problems occur in which depending on said hold-over time after adding salting-out agents, the coagulation state of particles varies, the particle size distribution fluctuates, and the surface properties of fused toner particles also varies. Temperature during addition of salting-out agents is not particularly limited.

In the invention, it is preferable to employ a method in which the dispersion of resinous particles is heated as quickly as possible so that said resinous particles are heated to a temperature higher than or equal to the glass transition point. Time required for increasing to said temperature is less than 30 minutes, and is preferably less than 10 minutes. Further, it is necessary to increase the temperature quickly and the rate of temperature increase is at least 1° C./minute. The upper limit has not yet been clarified, but from the viewpoint of retarding the formation of coarse particles due to the rapid progress of salting-out/fusion, said rate is preferably 15° C./minute or less. A particularly preferred state may be formed employing a method in which said salting-out/fusion continuously proceeds even when the temperature reaches at least the glass transition temperature. By utilizing said method, it is possible to effectively carry out fusion along with particle growth, whereby it is possible to enhance the durability of said finished toner.

Further, by carrying out said salting-out/fusion, employing divalent metal salts during coalescence, it becomes possible to specifically control the particle diameter. The reasons have not yet been studied well enough to be fully clarified. However, it is assumed that by employing said divalent metal salts, the repulsive force between particles becomes greater during salting-out, and as a result, it has become possible to control the particle size distribution.

Further, it is preferable that in order to terminate salting-out/fusion, univalent metal salts, as well as water, are added. By adding those, it is possible to terminate said salting-out. As a result, it becomes possible to control the quantity of particles having a larger diameter as well as the quantity of particles having a smaller diameter.

In a toner prepared by employing this polymerization method, which is prepared by coalescing or fusing resinous particles in water-based medium, it is possible to optionally vary the shape distribution, as well as the shape of the entire toner, by controlling the flow of the medium as well as the temperature distribution in the reaction vessel during the fusion stage, and further by controlling the heating temperature, the stirring rotation frequency, and the time during the shape controlling process after fusion.

Namely, in toner, prepared employing this polymerization method, which is prepared by coalescing or fusing resinous particles, it is possible to form toner having the shape factor as well as the uniform shape distribution of the invention, by controlling the temperature, the rotation frequency, and the time during the fusion process and the shape control process, employing stirring blades as well as a stirring vessel which make it possible to make the flow in the reaction apparatus a laminar flow, and the interior temperature distribution uniform. The reasons are assumed to be as follows. When said fusion is carried out in a field in which said laminar flow is formed, strong stress is not applied to particles (coalesced or coagulated particles) which are being subjected to coagulation and fusion. In addition, in said laminar flow in which the flow rate is accelerated, the temperature distribution in the stirring vessel is uniform. As a result, the shape distribution of particles formed through said fusion becomes uniform. Further, particles formed by fusion gradually vary into spheres due to heating and stirring following the shape control process, whereby it is possible to optionally control the shape of toner particles.

In order to adjust the toner particles of the invention to the specified shape, it is preferable to simultaneously carry out salting-out and fusion. A method, in which heating is carried out after forming coagulated particles, tends to result in non-uniform shape distribution, and in addition, cannot retard the formation of fine particles. Namely, it is assumed that coagulated particles are divided due to the fact that said coagulated particles are heated in a water-based medium while being stirred, whereby small diameter particles tend to be formed.

The developer employed in the invention will now be described.

When employed as a double component developer after blending with a carrier, employed as magnetic particles of said carrier may be any of the several conventional materials known in the art, such metals include iron, ferrite and magnetite and alloys of said metals with metals including aluminum and lead. Ferrite particles are particularly preferred. The volume average diameter of said magnetic particles is preferably from 15 to 100 μm, and is more preferably from 25 to 80 μm.

The volume average particle diameter of said carrier can be determined employing a representative apparatus such as a laser diffraction type size distribution measurement apparatus "HELOS" (manufactured by Sympatec Co.) fitted with a wet type homogenizer.

Preferred as said carrier are carriers comprised of magnetic particles further coated with resins, and a so-called resin dispersion type carrier prepared by dispersing magnetic particles into resins. Resin compositions for coating are not particularly limited. For example, employed may be olefin based resins, styrene based resins, styrene-acryl based resins, silicone based resins, ester based resins, or fluorine-containing polymer based resins. Further, resins for constituting said resin dispersion type carrier are also not particularly limited, and any of the several known in the art can be employed. For example, it is possible to employ styrene-acryl based resins, polyester resins, fluorine based resins, and phenol resins.

[4] Method for Development

The static latent image can be developed either by a single-component developer or a double-component developer. The one-component developer is constituted by at least a magnetic powder and a binder resin and a coloring agent may be contained therein.

A contact developing method or a non-contact developing method may either be employed. When the non-contact developing method is employed, a conventional development and a reversal development can be performed under the non-contact condition. The direct current electric field on such the occasion is from $1\times10^3$ to $1\times10^5$ V/cm, and is preferably from $1\times10^3$ to $1\times10^4$ V/cm, in absolute value. When the electric field is less than $1\times10^3$ V/cm, the development is made insufficient and the sufficient image density cannot be obtained. When the electric field exceeds $10^5$ V/cm, the image is roughened and fog is formed.

The alternative current bias is from 0.5 to 4 $kV_{p-p}$, and preferably from 1 to 3 $kV_{p-p}$, and the frequency of the bias is from 0.1 to 10 kHz, and is preferably from 2 to 8 kHz.

When the alternative current bias is less than 0.5 $kV_{p-p}$, the toner cannot be released from the carrier so that the development becomes insufficient and the image density is made insufficient. When the alternative current bias exceeds 4 $kV_{p-p}$, the carrier in the developer is scattered and adhered on the photoreceptor.

When the frequency of the bias is less than 0.1 kHz, the releasing of the toner from the carrier is also made difficult so that the incomplete development and insufficient image density tend to be resulted. When the frequency exceeds 10 kHz, the toner cannot be followed to the change of the electric field so that the incomplete development and insufficient image density also tend to be resulted.

[5] Constitution of the Cleaning Means and Others

A blade cleaning method employing an elastic rubber blade is preferably employed as the cleaning means. Urethane rubber and silicone rubber are employable as the elastic rubber, and the urethane rubber is particularly preferred.

When the image forming apparatus is used as a copying machine or a printer, the imagewise exposure is performed by irradiating light reflected by or transmitted through an original image to the photoreceptor, or by the following procedure; an original image is read by a sensor to convert to signals, and scanning by a laser beam, driving a LED alley or a liquid crystal shutter alley are performed according to the signals to image wise irradiate the light to the photoreceptor.

[6] Image Forming Method and Image Forming Apparatus.

The image forming method according to the invention can be applied to an usual image forming apparatus such as a copying machine, laser printer, a LED printer, a liquid crystal shutter type printer. Furthermore, the method can be widely applied to an apparatus utilizing the electrophotographic technology such as those for display, recording, light printing, plate making and facsimile.

Next, the image forming apparatus to be employed for the image forming method according to the invention is described below.

Figure 12:
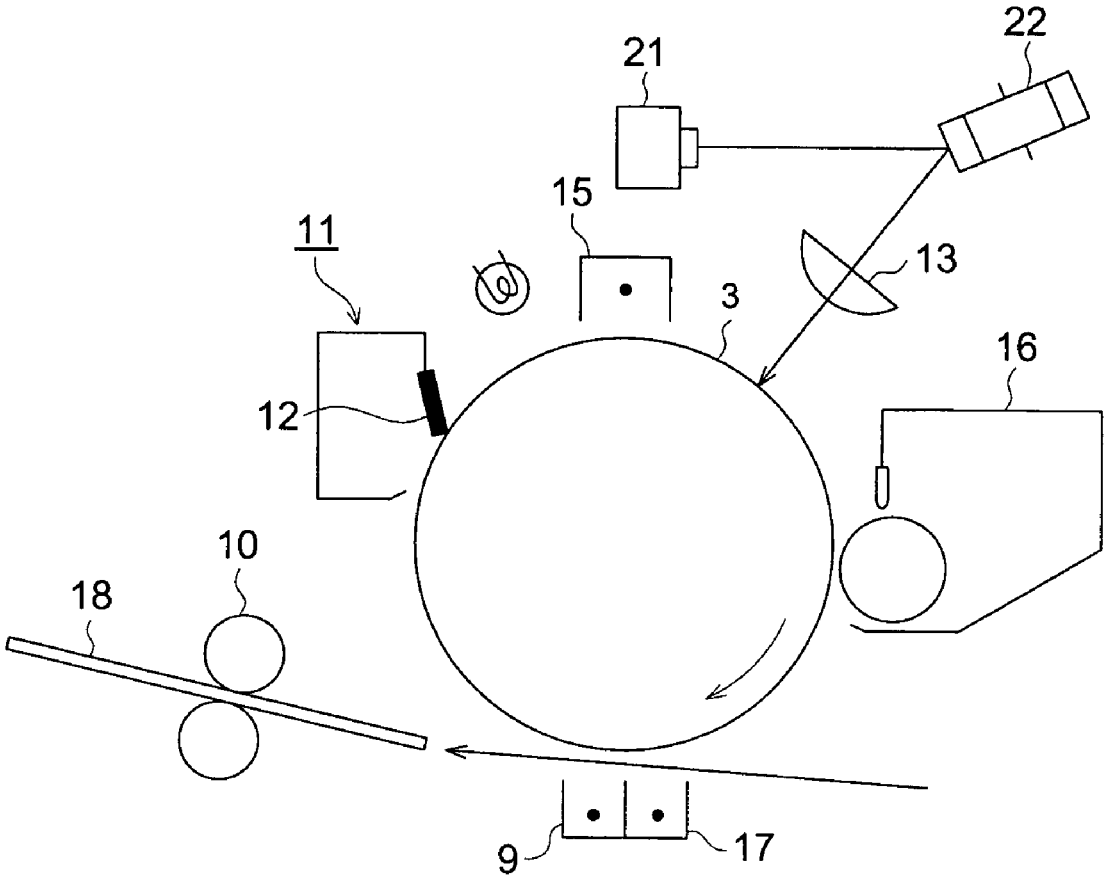
FIG. 12 is a cross section of an example of the image forming apparatus employing the photoreceptor drum.

FIG. 12 is a cross section displaying an example of the image forming apparatus to be employed in the image forming method according to the invention.

In the drawing, 3 is a photoreceptor drum as a image forming body, which comprises a an aluminum drum support and a layer of an organic photoelectric conductive substance (OPC) provided on the external periphery of the drum. The drum is rotated in the direction of the arrow at a prescribed speed.

In FIG. 12, a light beam is emitted from a semiconductor laser light source 21 according to the information read by an original image reading means, not shown in the drawing. The light beam is distributed by a polygon mirror 22 in the perpendicular direction to the paper face of FIG. 12 and irradiated onto the photoreceptor through an fθ lens 13 for compensating distortion of image to form a static latent image. The photoreceptor drum as the image forming body is previously given uniform charge by a charging device 15, and clockwise rotated synchronized with the timing of the imagewise exposing.

The static latent image formed on the surface of the photoreceptor drum is developed by a developing device 16, and the developed image is transferred by a transfer device 17 onto a image receiving paper which is conveyed synchronize with the timing. The image receiving paper 18 is separated from the photoreceptor 3 by a separation device (a separation electrode) 9, and the toner image transferred and carried by the image receiving paper is introduced into a fixing device 10 to be fixed.

The toner not transferred and remained on the photoreceptor surface is removed by a cleaning blade 12 of cleaning device 11; and the charge remained on the photoreceptor surface is removed by light exposure before charging (PCL). Then the photoreceptor surface is uniformly charged by the charging device 15 for next image formation.

[7] Toner Recycling System

The method for recycling the toner is not particularly limited, for example, the method is usable such as that the toner recovered in the cleaning device is conveyed by a conveyer or a conveying screw to a toner supplying hopper or developing device, or mixed with the toner to be newly supplied in an intermediate chamber and supplied to the developing device.

Figure 13:
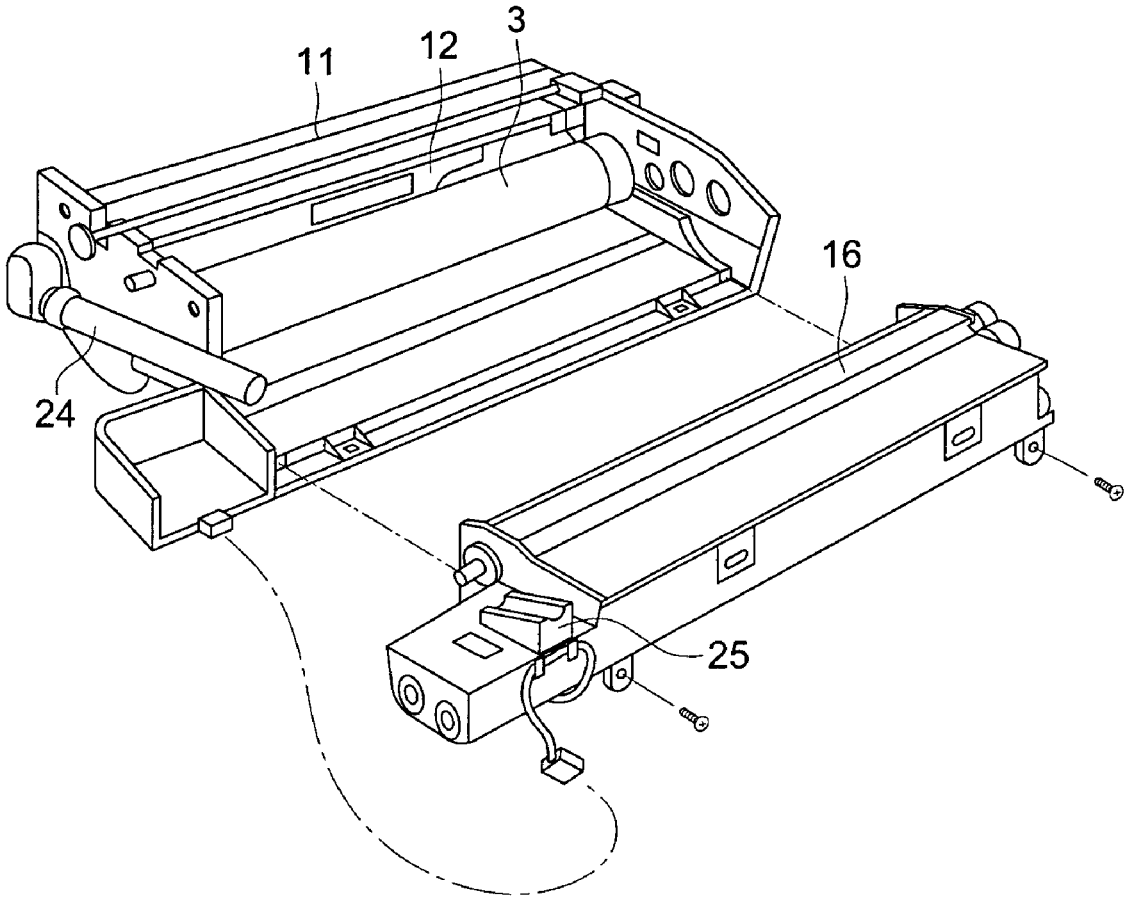
FIG. 13 is a slant view of an example of the toner recycle device.

FIG. 13 is a slanting view of an example of the toner recycling device. In this system, the recycled toner is directly returned to the developing device. The not transferred toner recovered by the cleaning blade 12 is collected to a toner recycling pipe 24 by a conveying screw in the toner cleaning device, and returned to the developing device 16 through a receiving mouth 25 to be reused as the developer.

FIG. 13 displays also a cross section of a processing cartridge capable of freely installing to and taking off from the image forming apparatus according to the invention. Although FIG. 13 displays the cartridge in a separated state to the photoreceptor unit and the developing unit for convenience of understanding, the cartridge can be installed in the image forming apparatus in a state of the entirely unified unit. In such the case, the photoreceptor, the developing device, the cleaning device and the recycling means constitute a unified processing cartridge.

The image forming apparatus may be taken a state in which a processing cartridge containing at least one of the photoreceptor drum, the charging device, the developing device, the cleaning device and the recycling device can be installed. Particularly, when the toner having the small diameter is employed, problems are caused by contamination of interior of the apparatus by the scattered toner and the toner scattering on the occasion of changing of the developer. In such the case, for example, a preferable cartridge according to the invention can be made by unifying the photoreceptor, the cleaning device and the cleaning device and previously charging the toner therein. Thus the cartridge capable of forming a high quality image without scattering of the toner can be obtained.

Although the image receiving paper is typically usual paper, any materials can be used as long as the unfixed toner image after the development can be transferred thereon. PET base of OHP use is included of course.

As above-described, the elastic rubber having a thickness of approximately from 1 to 30 mm is employed as the cleaning blade, urethane rubber is most frequently employed as the material of the cleaning blade. It is preferred in the invention that a releasing mechanism is attached to the cleaning blade so that the blade is detached from the photoreceptor during the image forming operation is paused.

The invention may be applied to an image forming apparatus by the electrophotographic method, particularly to an apparatus in which a static latent image is formed on a photoreceptor by a light beam modulated by digital image data from a computer.

Recently, in the field of the electrophotography for obtaining a visible image by developing a latent image formed on a photoreceptor drum, research and development of the image forming method utilizing a digital system have been actively carried out by which the improvement, conversion and edition of the image can be easily performed.

As the scanning optical system based on light modulation by digital image signals from the computer or the original image to be copied utilized in such the image forming method and apparatus, an apparatus in which a sono-optical modulation element is provided in the light way and the light beam is modulated by the element and an apparatus in which the a semi-conductor laser is used and the intensity of the laser light is directly modulated are usable. A dot image is formed by exposing the uniformly charged photoreceptor drum to a spot of light from such the scanning optical system.

The light beam emitted from the scanning optical system has a circular or oval intensity distribution near the normal distribution having extended bottom. For example, in the case of the laser beam, the shape of the spot on the photoreceptor is extremely narrow circular or oval such as that the length of one or both of the main scanning direction and the sub-scanning direction are from 20 to 100 μm.

Although the image forming apparatus in which the toner image is directly transferred from the photoreceptor to the image receiving paper is used herein, an image forming apparatus is not excluded in which the toner image is once transferred onto an intermediate transfer member as an image bearing member and then transferred to the image receiving paper from the intermediate transfer member. Such the image forming apparatus may either be an apparatus for forming a monochromatic image or that for forming a color image.

EXAMPLE

Examples employing the scouring tape according to the invention are described below, but the embodiment of the invention is not limited to the following examples.

1. Photoreceptor

Preparation of Photoreceptor 1

The following coating liquid was prepared and coated on an aluminum cylindrical support with a diameter of 30 mm manufactured by a pull out process to form a semi-electroconductive layer having a dried layer thickness of 15 μm.

<Coating Liquid of Semi-Electroconductive Layer (PCL)>

| | |
|---|---|
| Phenol resin | 160 g |
| Electroconductive titanium oxide | 200 g |
| Methyl cellosolve | 100 ml |

Then the following intermediate layer coating liquid was prepared, and coated onto the semi-electroconductive layer by an immersion coating method to form an intermediate layer having a thickness of 1.0 μm.

<Intermediate Layer (UCL) Coating Liquid>

| | |
|---|---|
| Polyamide resin Amilan CM-8000 (Toray Co., Ltd.) | 60 g |
| Methanol | 1600 ml |
| Butanol | 400 ml |

The following liquid of the following composition was dispersed for 10 minutes by a sand mill to prepare a charge generation layer coating liquid. The resulting liquid was coated by the immersion coating method onto the intermediate layer to form a charge generation layer having a thickness of 0.2 μm.

<Charge Generation Layer (CGL) Coating Liquid>

| | |
|---|---|
| Y-type titanylphthalocyanine | 60 g |
| Silicone resin solution KR5240, 15% xylene-butanol solution (Shin'etsu Kagaku Co., Ltd.) | 700 g |
| 2-butanone | 2000 ml |

The following compositions were mixed and dissolved to prepare a charge transfer layer coating liquid. The resulting liquid was coated by the immersion coating method onto the charge generation layer to form a charge transfer layer having a thickness of 20 μm. Thus Photoreceptor 1 was prepared.

<Charge Transfer Layer (CTL) Coating Liquid>

| | |
|---|---|
| Charge transfer substance | 200 g |
| Bisphenol Z type polycarbonate Iupilon Z300 (Mitsubishi Gas Kagaku Co., Ltd.) | 300 g |
| 1,2-dichloroethane | 2000 ml |

Preparation of Photoreceptor 2

The following intermediate layer coating liquid was coated on a cylindrical aluminum drum with a diameter of 30 mm by the immersion coating method and dried at 150° C. for 30 minutes to form an intermediate layer having a thickness of 1.0 μm.

<Intermediate Layer (UCL) Coating Liquid>

| | |
|---|---|
| Zirconium chelate compound ZC-540 (Matsumoto Seiyaku Co., Ltd.) | 200 g |
| Silane coupling agent KBM-903 (Shin'etsu Kagaku Co., Ltd.) | 100 g |
| Methanol | 700 ml |
| Ethanol | 300 ml |

Then, the following coating composition was mixed and dispersed for 10 hours by a sand mill to prepare a charge generation layer coating liquid. The resulting liquid was coated onto the intermediate layer by the immersion method to form a charge generation layer having a thickness of 0.2 μm.

<Charge Generation Layer (CGL) Coating Liquid>

| | |
|---|---|
| Y-type titanylphthalocyanine | 60 g |
| Silicone resin solution KR5240, 15% xylene-butanol solution (Shin'etsu Kagaku Co., Ltd.) | 700 g |
| 2-butanone | 2000 ml |

Next, the following coating composition was mixed and dissolved to prepare a charge transfer layer coating liquid. The coating liquid was coated onto the charge generation layer by the immersion method to form a charge transfer layer having a thickness of 20 μm. Thus Photoreceptor 2 was prepared.

<Charge Transfer Layer (CTL) Coating Liquid>

| | |
|---|---|
| Charge transfer substance | 200 g |
| Bisphenol Z type polycarbonate Iupilon Z300 (Mitsubishi Gas Kagaku Co., Ltd.) | 300 g |
| 1,2-dichloroethane | 2000 ml |

Preparation of Photoreceptor 3

The following coating composition was mixed and dissolved to prepare a protective layer coating liquid and coated onto Photoreceptor 2.

<Protective Layer (OCL) Coating Liquid>

Molecular Sieve 4A was added to 100 parts by weight of polysiloxane resin composed of 80 mole-% of methylsiloxane unit and 20 mole-% of methyl-phenylsiloxane unit and subjected to dehydration treatment after standing for 15 hours. The resin was dissolved in 10 parts by weight of toluene, and 5 parts by weight of methyltrimethoxysilane and 0.2 parts by weight of dibutyl tin acetate were added to the solution to prepare a uniform solution. To the solution, 6 parts by weight of dihydroxymethyltriphenylamine was added and mixed. Resulting solution was coated to form a protective layer having a thickness of 2 μm and thermally hardened at 120° C. for 1 hour. Thus Photoreceptor 3 was prepared.

Preparation of Photoreceptor 4

The following intermediate layer coating liquid was coated by the immersion coating method onto the cylindrical aluminum support with a diameter of 30 mm to form an intermediate layer having a dried thickness of 2 μm.

<Intermediate Layer (UCL) Coating Liquid>

A dispersion of the following composition was stood for one knight and then filtered by Ridimesh Filter, manufactured by Nihon Pall Co., Ltd., with a nominal precision of 5 μm, while applying a pressure of 5N/cm$^2$ to prepare an intermediate layer coating liquid.

Dispersion for Intermediate Layer

| | |
|---|---|
| Polyamide resin CM8000 (Toray Co., Ltd.) | 1.0 parts by weight |
| Titanium oxide SMT500SAS (Teika Co., Ltd., the surface was subjected to a silica treatment and methylhydrogensiloxane treatmet by silica) | 3.0 parts by weight |
| Methanol | 20 parts by weight |

The following composition was dispersed by batch method for 10 hours employing a sand mixer to prepare a charge generation layer coating liquid. The coating liquid was coated by the immersion method to form a charge generation layer having a thickness of 0.3 μm onto the intermediate layer.

<Charge Generation Layer (CGL) Coating Liquid>

| | |
|---|---|
| Y-type oxytitanylphthalocyanine showing a maximum peak of X-ray diffraction at a 2θ angle of 27.3° by Cu—Kα characteristic X-ray | 20 g |
| Poly(vinyl butyral) #6000C (Denki Kagaku Kogyo Co., Ltd.) | 10 g |
| t-butyl acetate | 700 g |
| 4-methoxy-4-methyl-2-pentanone | 300 g |

The following composition was mixed and dissolved to prepare a charge transfer layer coating liquid. The coating liquid was coated on the charge generation layer by the immersion method to form a charge transfer layer having a layer thickness of 24 μm.

<Charge Transfer Layer (CTL) Coating Liquid>

| | |
|---|---|
| Charge transfer substance | 75 g |
| Polycarbonate resin Iupilon Z300 (Mitsubishi Gas Kagaku Co., Ltd.) | 100 g |
| Dioxolane/toluene (mixing ratio in mole: 10/1) | 750 g |

2. Coated Layer Removing Method

A. <Method Employing the Tape>

Coated Layer Removing Method A-1

On the coated layer removing apparatus displayed in FIG. 7(*b*), the scouring tape and the photoreceptor drum were installed and the photoreceptor drum was rotated at a rate of from 5 to 30 rpm. Then the scouring tape impregnated with the solvent is contacted to the 10 mm width of the coated layer on the photoreceptor drum with a tilt angle of 1.0°. The tape was run at a speed of from 500 to 3,000 mm/min in the direction reverse to that of the rotation of the photoreceptor drum until the coated layer is removed. Thus coated layer was removed.

The scouring tape is contacted extending 15° on the periphery of the photoreceptor drum by two pressing rollers. A tension of 25N/20 mm width was applied between the let out roll and the take up roll.

Coated Layer Removing Method A-2

The method is the same as the method A-1 except that the tilt angle was not applied or 0.0.

B<Method Employing the Brush>

Coated Layer Removing Method B-1

The photosensitive layer is coated on the drum by the electrophotographic photoreceptor manufacturing apparatus shown in FIG. 8 so that about 1 cm width of non-coated area was made at the upper end of the support; and then the photoreceptor drum was move to the coated layer removing process. In the coated layer removing process, the series of operation described in FIG. 8 was performed to remove 1 cm width of the coated layer. After that, the drum was moved to the drying process to prepare the photoreceptor. The solvent charged in the solvent tank of the coated layer removing apparatus was methylene chloride the same as the solvent of the charge transfer layer. The scouring member of the coated layer removing stand was a rotating 0.5 mm polyester brush. The remaining solvent amount in the edge portion of the coated layer at the time of the start of coated layer removing was 12.0% by weight when the solvent amount of the coating liquid was defined as 100% by weight.

Coated Layer Removing Method B-2

The polyester brush the same as that used in the removing method B-1, but the coated layer removing stand was immersed in the solvent tank such as described in Example 1 of Japanese Patent O.P.I. Publication No. 5-142789 to remove the lower end portion of the coated layer.

The coated layer removing was performed by each of the combinations of the above-described Photoreceptors 1 through 4 and the removing methods A-1 through B-2 as shown in Table 1. Thus Drum Nos. 1 through 11 were prepared.

Results are listed in Table 1.

TABLE 1

| Drum No. | Photo-receptor No. | Removing method | Employed solvent | P (μm) | $P_{max}$ − P (μm) | $(P_{max}/D) \times 100$ | Removed situation at the edge portion | Within/ without the invention |
|---|---|---|---|---|---|---|---|---|
| 1 | 1 | A-1 | Methanol/methylene chloride = 1/1 | 20 | 7 | 3 | Good | Within |
| 2 | 2 | A-1 | Methanol/methylene chloride = 1/1 | 15 | 8 | 20 | Good | Within |
| 3 | 3 | A-1 | Methanol/methylene chloride = 1/1 | 30 | 20 | 10 | Good | Within |
| 4 | 4 | A-1 | Methanol/dioxolane = 1/1 | 25 | 21 | 5 | Good | Within |
| 5 | 1 | B-1 | Methanol/methylene chloride = 1/1 | 22 | 18 | 40 | Good | Within |
| 6 | 2 | B-1 | Methanol/methylene chloride = 1/1 | 16 | 0 | 10 | Good | Within |
| 7 | 3 | B-1 | Methanol/methylene chloride = 1/1 | 26 | 19 | 10 | Good | Within |
| 8 | 4 | B-1 | Methanol/dioxolane = 1/1 | 20 | 3 | 3 | Good | Within |
| 9 | 2 | A-2 | Methanol/dioxolane = 1/1 | 16 | 20 | 20 | Projection of the edge is large and easily come off. | Without |
| 10 | 3 | A-2 | Methanol/dioxolane = 1/1 | 26 | 8 | 1 | The thin portion of the edge is overlapped with the image area. | Without |
| 11 | 3 | B-2 | Methanol/dioxolane = 1/1 | 26 | 12 | 55 | Burrs rise and are easily peeled. | Without |

2. Developer

<<Preparation of Latex 1>>

A solution of 7.08 g of anionic surfactant, sodium dodecylbenzenesulfonate (SDS) dissolved in 2760 g of deionized water was put into a 5000 ml separable flask, to which a stirring device, a thermo-sensor, a cooler and a nitrogen gas introducing device. The content of the flask was raised by 80° C. under a nitrogen stream while stirring at a speed of 230 rpm. On the other hand, 72.0 g of Exemplified Compound 19 was added to a monomer mixture composed of 115.1 g of styrene, 42.0 g of n-butyl acrylate and 10.9 g of methacrylic acid, and dissolved by heating by 80° C. to prepare a monomer solution. The above two heated solutions were mixed and dispersed by a mechanical dispersing apparatus having a circulation pass to prepare an emulsified particles each having uniform particle diameter. And then a polymerization initiator solution composed of 0.84 g of potassium persulfate (KPS) and 200 g of deionized water was added to the emulsion and stirred for 3 hours at 80° C. to prepare latex particles. Continuously, a solution of 7.73 g of polymerization initiator (KPS) dissolved in 240 ml of deionized water was added. After 15 minutes of that, a mixture of 383.6 g of styrene, 140.0 g of n-butyl acrylate, 36.4 g of methacrylic acid and 14.0 g of n-octyl 3-mercaptopropionate was dropped into the latex spending 120 minutes. After the dropping, the latex was heated and stirred for 60 minutes and cooled by 40° C. to obtain latex particles. Thus obtained latex particles were referred to as Latex 1.

<<Preparation of Colored Particle>>

(Preparation of Colored Particle 1Bk)

In 160 ml of deionized water, 9.2 g of sodium n-dodecylsulfate was dissolved. To the solution, 20 g of Regal 330R, carbon black produced by Cabot co., Ltd., was gradually added while stirring, and then dispersed by a dispersing machine Cleamix. As a result of measuring the particle diameter of the above dispersion by an electrophoretic light scattering photometer ELS-800, manufactured by Ootsuka Denshi Co., Ltd., the weight average particle diameter was 112 nm. Thus obtained dispersion was referred to as Colorant Dispersion 1.

To a 5 liter four mouth flask, to which a thermal sensor, a cooler, a nitrogen gas introducing device and a stirring device were attached, 1250 g of Latex 1, 2000 ml of deionized water and Colorant Dispersion 1 were put and stirred. After adjusting the temperature at 30° C., a 5 moles/liter aqueous solution of sodium hydroxide was added to the above mixture to adjust the pH of the mixture to 10.0. Then an aqueous solution of 52.6 g of magnesium chloride hexahydrate in 72 ml of deionized water was dropped spending for 5 minutes at 30° C. After that, the mixture liquid was stood for 2 minutes and then heated by 90° C. spending for 5 minutes; the rising rate of temperature was 12° C./minute.

In such the situation, the particle diameter was measured by Coulter Counter TA II and an aqueous solution of 115 g sodium chloride dissolved in 700 ml of deionized water was added to stop growing of the particles at the time when the volume average diameter of the particles was become to 4.3 μm. In succession, the liquid was stirred for 8 hours at 85±2° C. to salt out and adhere by fusion the particles. Thereafter, the liquid was cooled by 30° C. in a rate of 6° C./minute, and hydrochloric acid was added to adjust the pH value to 2.0, and then stirring was stopped. Thus formed particles were filtered, washed and dried by warmed air at 40° C. to obtain colored particles. Thus obtained was referred to as Colored Particle 1Bk.

(Preparation of Colored Particle 1Y)

Colored particles were prepared in the same manner as in Colored Particle 1Bk except that C. I. Pigment Yellow 185 was employed in place of the carbon black. The obtained was referred to as Color Particle 1Y.

(Preparation of Colored Particle 1M)

Colored particles were prepared in the same manner as in Colored Particle 1Bk except that C. I. Pigment Red 122 was employed in place of the carbon black. The obtained was referred to as Color Particle 1M.

(Preparation of Colored Particle 1C)

Colored particles were prepared in the same manner as in Colored Particle 1Bk except that C. I. Pigment Blue 15:3 was employed in place of the carbon black. The obtained was referred to as Color Particle 1C.

(Preparation of Colored Particles 2Bk, 3Bk, 4Bk and 5Bk)

Colored Particles 2Bk through 5Bk were each prepared in the same manner as in Colored Particle 1Bk except that the production conditions were changed as given in Table 2.

(Preparation of Colored Particles 6Bk and 7Bk)

Colored Particles 6Bk and 7Bk were each prepared in the same manner as in Colored Particle 1Bk except that the production conditions were changed as given in Table 2 and the growing of the particle was stopped when the volume average diameter of the particles become 3.8 μm.

(Preparation of Colored Particle 4Y)

Colored particles were prepared in the same manner as in Colored Particle 4Bk except that C. I. Pigment Yellow 185 was employed in place of the carbon black. The obtained was referred to as Color Particle 4Y.

(Preparation of Colored Particle 4M)

Colored particles were prepared in the same manner as in Colored Particle 4Bk except that C. I. Pigment Red 122 was employed in place of the carbon black. The obtained was referred to as Color Particle 4M.

(Preparation of Colored Particle 4C)

Colored particles were prepared in the same manner as in Colored Particle 4Bk except that C. I. Pigment Blue 15:3 was employed in place of the carbon black. The obtained was referred to as Color Particle 4C.

The preparation conditions and properties of each of the colored particles were listed in Tables 2 and 3, respectively.

TABLE 2

| Colored particle No. | Adding amount of magnesium chloride (g) | Temperature raising rate (° C./min.) | Salting off/adhering by fusion: Liquid temperature (° C.) | Salting off/adhering by fusion: Holding time (hrs) |
|---|---|---|---|---|
| 1Bk | 52.6 | 12 | 85 ± 2 | 8 |
| 2Bk | 52.6 | 20 | 90 ± 2 | 6 |
| 3Bk | 52.6 | 5 | 90 ± 2 | 6 |
| 4Bk | 26.3 | 12 | 85 ± 2 | 8 |
| 5Bk | 78.9 | 12 | 85 ± 2 | 8 |
| 6Bk | 52.6 | 12 | 85 ± 2 | 8 |
| 7Bk | 26.3 | 12 | 85 ± 2 | 8 |

TABLE 3

| Colored particle No. | 50% volume average particle diameter (Dv50) (μm) | 50% number average particle diameter (Dp50) (μm) | Dv50/Dp50 | 75% volume average particle diameter (Dv75) (μm) | 75% number average particle diameter (Dp75) (μm) | Dv75/Dp75 | Percentage of particle number having not more than 0.7 × Dp50 | Within/without of the invention |
|---|---|---|---|---|---|---|---|---|
| 1Bk | 4.6 | 4.3 | 1.07 | 4.1 | 3.7 | 1.11 | 7.8 | Within |
| 1Y | 4.6 | 4.3 | 1.07 | 4.1 | 3.7 | 1.11 | 7.6 | Within |
| 1M | 4.7 | 4.4 | 1.07 | 4.2 | 3.7 | 1.14 | 7.9 | Within |
| 1C | 4.6 | 4.3 | 1.07 | 4.1 | 3.7 | 1.11 | 7.8 | Within |
| 2Bk | 4.8 | 4.5 | 1.07 | 4.2 | 3.7 | 1.14 | 5.5 | Within |
| 3Bk | 4.5 | 4.1 | 1.1 | 4.0 | 3.4 | 1.18 | 8.2 | Within |
| 4Bk | 4.6 | 3.7 | 1.24 | 4.1 | 3.1 | 1.32 | 13.6 | Without |
| 4Y | 4.6 | 3.7 | 1.24 | 4.1 | 3.1 | 1.32 | 13.6 | Without |
| 4M | 4.6 | 3.7 | 1.24 | 4.1 | 3.1 | 1.32 | 13.5 | Without |
| 4C | 4.6 | 3.7 | 1.24 | 4.1 | 3.1 | 1.32 | 13.3 | Without |
| 5Bk | 4.7 | 4.3 | 1.09 | 4.1 | 3.6 | 1.14 | 6.3 | Within |
| 6Bk | 3.9 | 3.7 | 1.05 | 3.3 | 2.8 | 1.18 | 6.8 | Within |
| 7Bk | 3.8 | 3.0 | 1.27 | 3.2 | 2.4 | 1.33 | 14.6 | Without |

The measured data of Colored Particles 1Y, 1M and 1C, and those of 4Y, 4M and 4C were each the same as those of Colored Particles 1Bk and 4Bk, respectively.

<<Preparation of Toner>>

To each of above-obtained Colored Particles of 1Bk through 7Bk, 1Y, 1M, 1C, 4Y, 4M and 4C, 1% by weight of hydrophobic titanium oxide having a number average premier particle diameter of 20 nm and a hydrophobicity of 68 was added and mixed by a Henschel mixer to obtain Toners 1Bk through 7Bk, 1Y through 1C and 4Y through 4C.

The physical properties of the toners such as the shape and the particle diameter were the same as those of the colored particles.

<<Preparation of Developer>>

To each of the above toners, a silicone coated ferrite carried having a volume an average particle diameter of 60 μm was mixed to prepare Developers 1Bk through 7Bk, 1Y through 1c and 4Y through 4C, respectively, each having a toner concentration of 6%.

Images were formed by a combination of one of the above Drums 1 through 11 and one of the above Developers such as described in Table 3 using a digital copying machine Sitios Konica 7040, manufactured by Konica Corp, and the images were compared and evaluated.

<<Evaluation of Image Quality>>

An original image which is divided into four portions of equal area and a character image having a pixel ratio of 7%, a portrait, a solid white image and a black solid image are arranged in the portions, respectively, was continuously copied 100,000 times on A4 sized paper, and the copy images were evaluated after finish of the continuous copying. An optical densitometer RD-918, manufactured by Macbeth Co., Ltd., was used when densitometry was necessary.

Unevenness of Image

The unevenness of the image was judged by the difference in the half tone image (ΔHD=Density at the portion far 1 cm from the edge−Density at the central portion).

A . . . Not more than 0.05; Good

B . . . More than 0.05 and less than 0.1; No problem in practical use

C . . . Not less than 0.1; Problems are raised in practical use.

Black Spot

A . . . Frequency of black spot 0f more than 0.4 mm: Not more than 3 spots in A4 size as to the entire copied images B . . . Frequency of black spot 0f more than 0.4 mm: one or more images having not less than 4 and not more than 19 spots in A4 size were found.

C . . . Frequency of black spot 0f more than 0.4 mm: one or more images having not less than 20 spots in A4 size were found.

Peeling of Coated Layer

The edge portion of the photoreceptor was observed after continuous copying to observe the situation of the peeling of the coated layer from the edge portion.

A . . . Peeling at the edge portion was not observed.

B . . . A little peeling at the edge portion was observed; Not problem in practical use.

C . . . Peeling at the edge portion was observed; Problems are raised in practical use.

Contamination by Toner

Interior of the image forming apparatus and the surface of photoreceptor were observed after 10,000 times of the test copying to confirm the occurrence of the contamination by the toner.

A . . . Scattered tone was not observed.

B . . . Scattered toner was slightly observed.

C . . . Scattered toner was observed.

Sharpness

The sharpness of the image was judged by the fine line image. Moreover, a complicated Chinese letter "麤" was copied by 10 generations and the copied letters were visually observed by 10 persons to judge the limit of the readability of the letter.

The generation number capable of reading as the letter is judged by the average of the observation result of the 10 persons.

A . . . Not less than $9^{th}$ generation

B . . . Fifth to $8^{th}$ generation

C . . . Not more than $4^{th}$ generation

Thus obtained results are listed in Table 4.

TABLE 4

| Example/ Comparative | Drum No. | Developer No. | Unevenness of image | Contamination by toner | Black spot | Peeling of layer at edge portion | Sharpness |
|---|---|---|---|---|---|---|---|
| Example 1 | 1 | 1Bk | A | A | A | A | A |
| Example 2 | 2 | 1Bk | A | A | A | A | A |
| Example 3 | 3 | 2Bk | A | B | A | A | B |
| Example 4 | 4 | 2Bk | A | B | A | A | B |
| Example 5 | 5 | 3Bk | A | A | A | A | A |
| Example 6 | 6 | 3Bk | A | A | A | A | A |
| Example 7 | 7 | 1Bk | A | A | A | A | A |
| Example 8 | 8 | 2Bk | A | B | A | A | B |
| Comparative 1 | 9 | 5Bk | C | C | C | C | B |
| Comparative 2 | 10 | 2Bk | B | C | B | B | B |
| Comparative 3 | 11 | 6Bk | C | C | C | C | B |
| Comparative 4 | 1 | 4Bk | C | C | B | B | C |
| Comparative 5 | 2 | 7Bk | C | C | B | B | C |

It is clear from Table 4 that the combinations of the photoreceptor and the developer according to the invention or Example is higher in the image quality and superior in the cleaning ability compared with those of the compound without the invention or Comparative.

Developers 1Y, 1M and 1C, and 4Y, 4M and 4C show each the properties similar to those of Developer 1Bk and 4Bk, respectively.

In the above examples, the embodiments of the invention, which include the electrophotographic image forming method, image forming apparatus and the processing cartridge and the photoreceptor to be employed was able to provide the results that the coated layer was nor peeled at the edge portion thereof, the toner was not accumulated, and image defects such as the black spot caused by the powdered coated layer and the scattered toner were not formed.

What is claimed is:

1. An image forming method comprising:

developing a latent image formed on an electrophotographic photoreceptor with a toner, wherein the photoreceptor comprises a support and a layer and the photoreceptor satisfies a condition represented by Formulas (1) and (2), and the toner has a ratio (Dv50/Dp50) of 50% volume particle diameter of the toner (Dv50) to 50% number particle diameter of the toner (Dp50) within the range of 1 to 1.15, a ratio (Dv75/Dp75) of the cumulative 75% volume particle diameter from the largest particle diameter of the toner (Dv75) to the cumulative 75% number particle diameter from the largest particle diameter of the toner (Dp75) within the range of 1 to 1.2 and 10% or less of the number of toner particles having a particle diameter of not larger than 0.7×Dp50 in the toner based on all the toner particles in the toner;

$$P<P_{max}<2P \quad \text{Formula (1)}$$

$$2\leqq(P_{max}/D)\times100\leqq50 \quad \text{Formula (2)}$$

wherein P represents an average of the thickness (μm) of the layer at the central portion of the support in the width direction of the image formation, $P_{max}$ represents an average of the maximum value of the layer thickness (μm) at the area without the image formation area, and D represents an average distance (μm) from the edge of the layer to the point where the maximum value is formed, and wherein the Pmax is 23 to 60 μm, and the P is 15 to 35 μm.

2. The image forming method of claim 1, comprising charging the photoreceptor, forming the latent image, transferring a toner image formed by the developing step, and cleaning a part of the toner remained on the photoreceptor after the transferring.

3. The image forming method of claim 2, wherein the support is an endless belt.

4. The image forming method of claim 2, wherein the photoreceptor has cylindrical shape.

5. The image forming method of claim 1, wherein the number of toner particles having a particle diameter of not larger than 0.7×Dp50 in the toner is 5 to 9% of the number of all the toner particles in the toner.

6. The image forming method of claim 5, wherein the 50% volume particle diameter (Dv50) is 2 to 8 μm.

7. The image forming method of claim 6, wherein the toner comprises a compound represented by formula A:

$$R^1\text{—}(OCO\text{—}R^2)_n \quad \text{Formula A}$$

wherein n represents integer of 1, 2, 3 or 4, $R^1$ and $R^2$ each represents a hydrocarbon group which may have a substituent.

8. The image forming method of claim 1, wherein the 50% volume particle diameter (Dv50) is 2 to 8 μm.

9. The image forming method of claim 1, wherein the 50% number particle diameter (Dp50) is 2 to 7.5 μm.

10. The image forming method of claim 1, wherein the average thickness of the charge transporting layer is 5 to 15 μm.

11. The photoreceptor of claim 4, further comprising a photosensitive layer and an intermediate layer between the support and the photosensitive layer.

12. The image forming method of claim 1, wherein the number of toner particles having a particle diameter of not larger than 0.7×Dp50 in the toner is 5 to 9% of the number of all the toner particles in the toner.

13. The image forming method of claim 1, wherein the 50% volume particle diameter (Dv50) is 2 to 8 μm.

14. The image forming method of claim 1, wherein the 50% number particle diameter (Dp50) is 2 to 7.5 μm.

15. The image forming method of claim 1, wherein the average thickness of the charge transporting layer is 5 to 15 μm.

16. The image forming method of claim 1, further comprising:

transferring the toner to an image forming medium;

cleaning the toner remained on the photoreceptor after the transferring step with a cleaning device; and conveying the toner in the cleaning device to mix with a new toner.

* * * * *